US009239153B2

(12) United States Patent
Goodman et al.

(10) Patent No.: US 9,239,153 B2
(45) Date of Patent: Jan. 19, 2016

(54) LIGHT FIXTURES AND PROCESSES FOR USE THEREOF

(71) Applicant: LumenOptix, LLC, Montgomeryville, PA (US)

(72) Inventors: Jay Goodman, Blue Bell, PA (US); Jaroslav Valerian, Harleysville, PA (US); Yoram Weiss, Cherry Hill, NJ (US)

(73) Assignee: LumenOptix, LLC, Montgomeryville, PA (US)

( * ) Notice: Subject to any disclaimer, the term of this patent is extended or adjusted under 35 U.S.C. 154(b) by 36 days.

(21) Appl. No.: 13/768,590

(22) Filed: Feb. 15, 2013

(65) Prior Publication Data

US 2013/0215623 A1 Aug. 22, 2013

Related U.S. Application Data

(60) Provisional application No. 61/600,391, filed on Feb. 17, 2012, provisional application No. 61/682,974, filed on Aug. 14, 2012.

(51) Int. Cl.

| | |
|---|---|
| ***F21V 19/02*** | (2006.01) |
| ***F21V 21/00*** | (2006.01) |
| ***F21S 8/02*** | (2006.01) |
| ***F21V 17/16*** | (2006.01) |
| *F21V 19/00* | (2006.01) |
| *F21Y 101/02* | (2006.01) |

(Continued)

(52) U.S. Cl.

CPC ..... *F21V 21/00* (2013.01); *F21S 8/026* (2013.01); *F21V 17/164* (2013.01); *F21V 21/042* (2013.01); *F21V 29/77* (2015.01); *F21Y 2101/02* (2013.01)

(58) Field of Classification Search

CPC ..... F21V 21/00; F21V 17/164; F21S 8/026

USPC ..... 362/147–150, 249.01–249.19, 362/277–289, 341–350

See application file for complete search history.

(56) References Cited

U.S. PATENT DOCUMENTS

| | | | |
|---|---|---|---|
| 3,683,173 | A | 8/1972 | Guth, Jr |
| 4,327,403 | A | 4/1982 | Capostagno et al. |
| 4,420,802 | A | 12/1983 | Smester et al. |

(Continued)

FOREIGN PATENT DOCUMENTS

| | | | |
|---|---|---|---|
| EP | 2037168 | A1 | 3/2009 |
| EP | 2322847 | A2 | 5/2011 |

*Primary Examiner* — Anh Mai
*Assistant Examiner* — Nathaniel Lee
(74) *Attorney, Agent, or Firm* — Dilworth Paxson LLP

(57) ABSTRACT

A light housing is provided. Housing comprises plate with light communication for LED luminaire attached to upper surface of plate, annular base having a rim, plurality of supports connecting plate to annular base, slots in each of plurality of supports; and retention clips engaged within slots. Housing includes j-box rotatably secured by support to plate with mounting brackets which include locking detents to maintain support in upper or lower positions. Also provided is fixture assembly comprising housing with LED light attached thereto. Further methods for installing assembly are provided and include positioning assembly through hole in ceiling substantially within above-ceiling space, locking retention clips against plurality of supports to maintain assembly in position relative to ceiling; and engaging upper rim of reflector with deflection clips attached to bottom surface of plate of assembly.

38 Claims, 40 Drawing Sheets

(51) Int. Cl.
*F21V 21/04* (2006.01)
*F21V 29/77* (2015.01)

(56) References Cited

U.S. PATENT DOCUMENTS 4,745,533 A 5/1988 Smerz
5,077,650 A 12/1991 Cestari
5,124,901 A 6/1992 Sojka
5,374,812 A 12/1994 Chan et al.
5,562,343 A 10/1996 Chan et al.
5,957,573 A 9/1999 Wedekind et al.
6,336,613 B1 1/2002 Roth
6,343,873 B1 2/2002 Eberhard et al.
6,350,047 B1 2/2002 Ng et al.
7,534,014 B1 * 5/2009 Pelletier ..... F21S 8/02 362/147
7,950,834 B2 5/2011 Dupre
8,070,328 B1 12/2011 Knoble et al.
8,142,057 B2 3/2012 Roos et al.
2008/0080195 A1 4/2008 Steadman et al.
2012/0044703 A1 2/2012 Wilson et al.
2012/0044704 A1 2/2012 Wilson et al.
2013/0063015 A1 * 3/2013 Concepcion ..... F21V 17/00 313/46

* cited by examiner

LIGHT FIXTURES AND PROCESSES FOR USE THEREOF

CROSS-REFERENCE TO RELATED APPLICATIONS

This application claims the priority and benefit of U.S. Provisional Patent Application Ser. No. 61/600,391, entitled "Light Fixtures and Processes of Use Thereof," filed Feb. 17, 2012, and of U.S. Provisional Patent Application Ser. No. 61/682,974, entitled "Light Fixtures and Processes of Use Thereof," filed Aug. 14, 2012, the entirety of which are incorporated herein by reference.

FIELD OF THE INVENTION

The invention relates generally to apparatus and processes for light fixtures and retrofit light fixtures and specifically to LED downlight fixtures.

BACKGROUND OF THE INVENTION

LED lighting technology has become an alternative to fluorescent, incandescent, and high-intensity discharge (HID) lighting in commercial and residential settings. Similar to the market entry of many new and emerging technologies, LED lights have been expensive to buy and install, and, as a consequence, consumers have relied on less costly alternative lighting, such as, for example, incandescent, fluorescent, or HID lighting. Although the upfront costs for LED lights are higher when compared to alternative lighting, LED lights provide significant long-term benefits. For example, LED lights use less energy than alternative lighting. This results in lower electric bills. LED lights provide illumination for a much longer time period than alternative lighting. This longer life reduces the frequency of bulb replacement and related costs. LED technology has evolved in recent years to provide aesthetically-appealing illumination, and, consequently, LED lighting has become a cost-effective, feasible alternative to other sources of lighting.

The benefits of LED fixtures have drawn the attention of commercial and residential consumers. This has led to an increase in the selection and installation of LED lighting in new construction, and, also, the replacement of traditional light fixtures with LED fixture retrofits in existing building infrastructure. New installation of LED fixtures is a straightforward process because rough-in kits or remodeling ring can be placed during construction. Retrofitting existing fixture infrastructure can be challenging because the existing fixture must be removed and the rough-in kit used and/or modified for new fixture.

Thus, there is a need for LED fixtures that (1) can be used for new and retrofit installations, (2) are cost effective to install, (3) are simple to install, (4) can be installed without the use of tools or a minimal amount of tools, (5) interface with existing rough-in kits in retrofitting installations, (6) can be installed with existing infrastructure (rough-in kits and holes in the ceiling or tile) without the need to further cut into the ceiling or tile, (7) can be installed from below the ceiling through existing holes in the ceiling and rough-in kit or a remodeling ring 400, (8) provide illumination that is aesthetically-appealing to consumers, and (9) are environmentally conscious because they do not implement lead and mercury typically used in other types of light fixtures. The invention addresses these needs.

BRIEF DESCRIPTION OF THE DRAWINGS

Additional aspects, features, and advantages of the invention, as to its structure, installation, operation, and use, will be understood and become more readily apparent when the invention is considered in light of the following description of illustrative embodiments made in conjunction with the accompanying drawings, wherein.

DETAILED DESCRIPTION OF EMBODIMENTS OF THE INVENTION

Figure 1B:
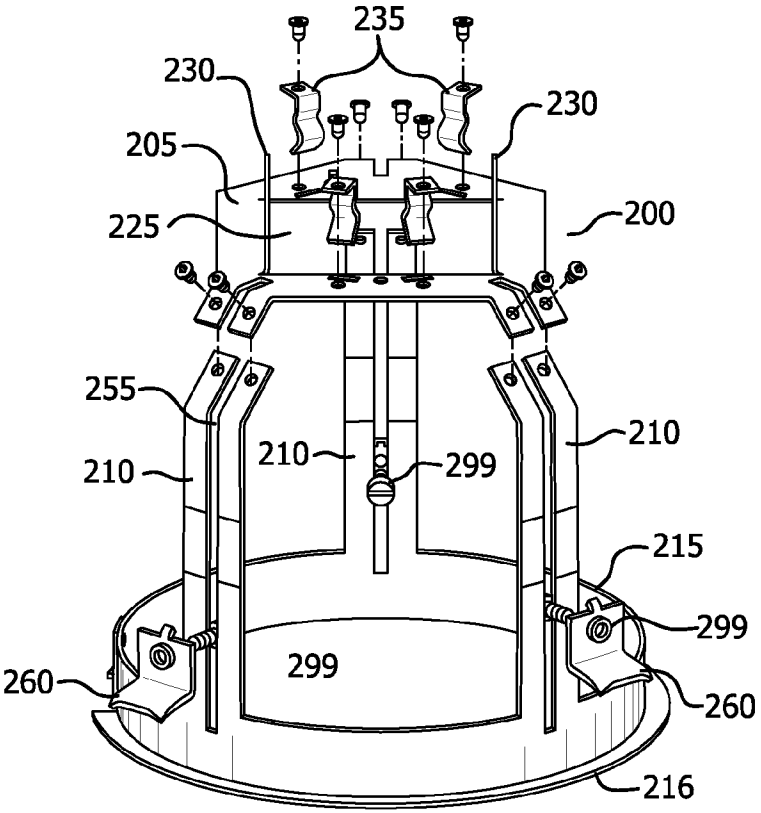
FIG. 1*b* shows an exploded, perspective view of the rear of the mounting assembly shown in FIG. 1*a*.
Figure 1A:
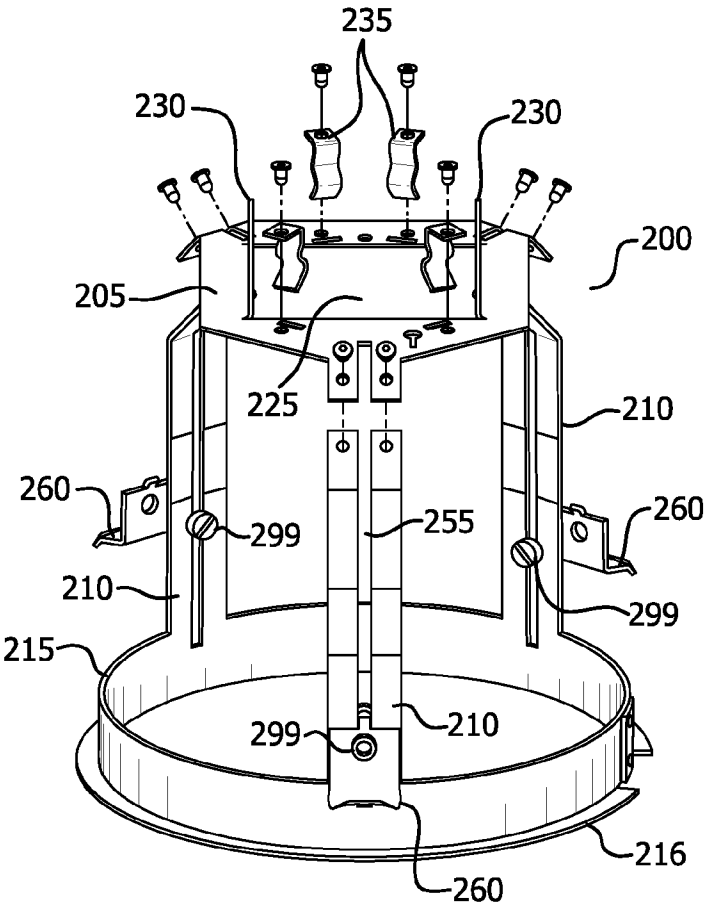
FIG. 1*a* shows an exploded, perspective view of the front of a mounting assembly according to an illustrative embodiment of the invention.
Figure 1D:
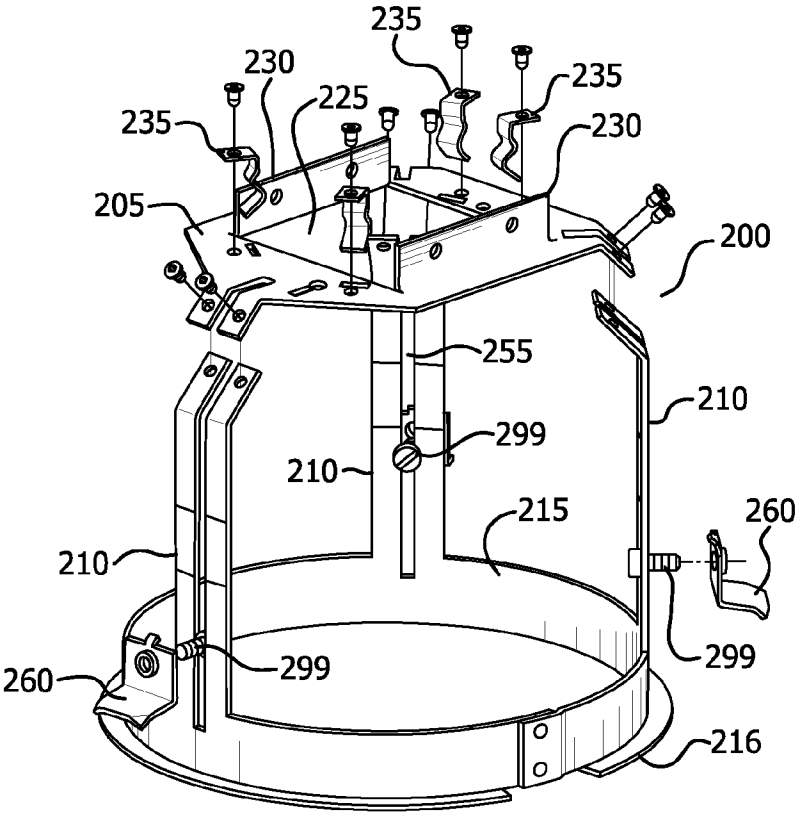
FIG. 1*d* shows an exploded, perspective view of the right side of the mounting assembly shown in FIG. 1*a*.
Figure 1C:
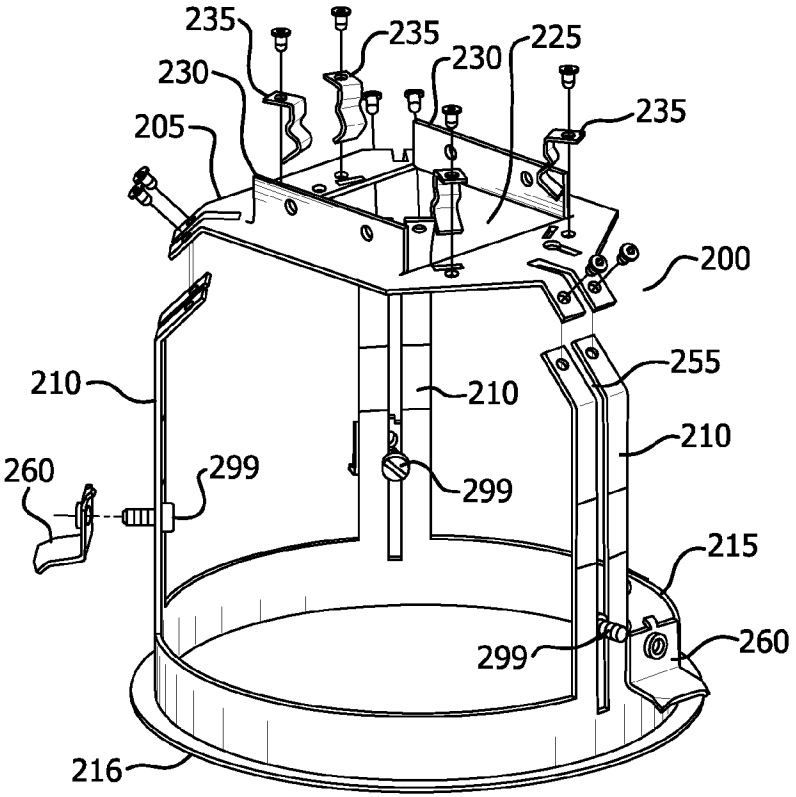
FIG. 1*c* shows an exploded, perspective view of the left side of the mounting assembly shown in FIG. 1*a*.

Illustrative and alternative embodiments of apparatus and processes for light fixtures and retrofit light fixtures and specifically to LED downlight fixtures are described in reference to the figures of the application. While illustrative embodiments of the invention are shown and described as fixture assembly 10 or 1010, alternative embodiments of the invention as well as its features, components, and functionality are described in this application.

Embodiments of the invention can be used in new construction and as retrofits or replacements for installed lighting assemblies. Accordingly, the invention provides processes for installing fixture assemblies 10 and 1010 in new construction, such as, high bay, low bay, ceiling space, and the like, and, also, in retrofitting existing light fixtures, such as, fluorescent, incandescent, or HID lighting in high bay, low bay, ceiling space, and the like. In new construction, a rough-in kit (e.g., plate, j-box, ballast, and electric supply) or alternatively remodeling ring 1400 must be positioned above the ceiling or ceiling tile and a hole must be cut through the ceiling or ceiling tile to correspond with a hole in the plate of the rough-in kit or in remodeling ring 1400. In retrofit applications, the reflector of an existing, installed fixture must be removed and the rough-in kit (plate, j-box, ballast, and electric supply) can be left in place above the ceiling and used with the installation of fixture assembly 10 or 1010. Alternatively, the rough-in kit can be displaced or removed and a remodeling ring 1400 used in its place.

Illustrative embodiments of fixture assembly 10 are shown in FIGS. 2*a*-4*e*. Assembly 10 comprises mounting assembly 200, LED driver 300, LED light 400, and reflector 500.

Referring now to FIGS. 1*a*-4*h*, mounting assembly 200 comprises plate 205 attached to a plurality of support arms 210 contiguous with ring 215 having flange 216. In an embodiment shown in FIGS. 1*a*-1*d*, plate 205 has communication 225. Communication 225 has a square shape defined by edges of plate 205 as shown in FIGS. 1*a*-1*d*. While illustrated as a square, the geometric shape of communication 225 may comprise any suitable geometric shape, e.g., round, oval, triangular, rectangular, etc. The geometric shape can be configured to correspond with the shape of LED light 400 intended for use with fixture assembly 10. Communication 225 permits emission of illumination from LED light 400 secured to mounting plates 230.

Two mounting plates 230 projecting at about 90 degrees from the surface of plate 205 positioned adjacent to communication 225. Mounting plates 230 are provided to secure LED light 400 accompanied with LED driver 300 to mounting assembly 200 as shown, for example, in FIGS. 2*a*-4*e*. Furthermore, a plurality of deflection clips 235 can be attached to plate 205 also shown in FIGS. 2*a*-4*e*. Deflection clips 235 have indentations which engage upper rim 501 of the assembly's reflector 500.

In an alternative embodiment, torsion springs 1300 (which are described greater detail relative to fixture assembly 1010) may be used in place of deflection clips 235. Torsion springs 1300 provide a functionality that is similar to deflection clips 235. Plate 205 can be configured with communications (similar to that of top platform 1020) to secure torsion springs in place to plate 205.

Figure 2B:
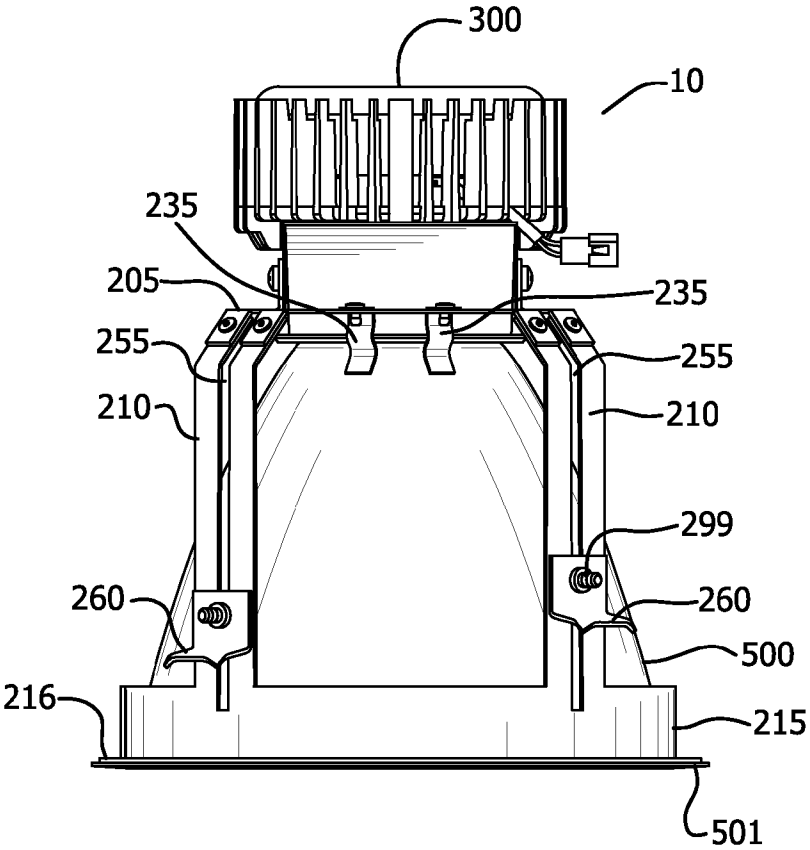
FIG. 2*b* shows an elevation view of the rear of the fixture assembly shown in FIG. 2*a*.
Figure 2A:
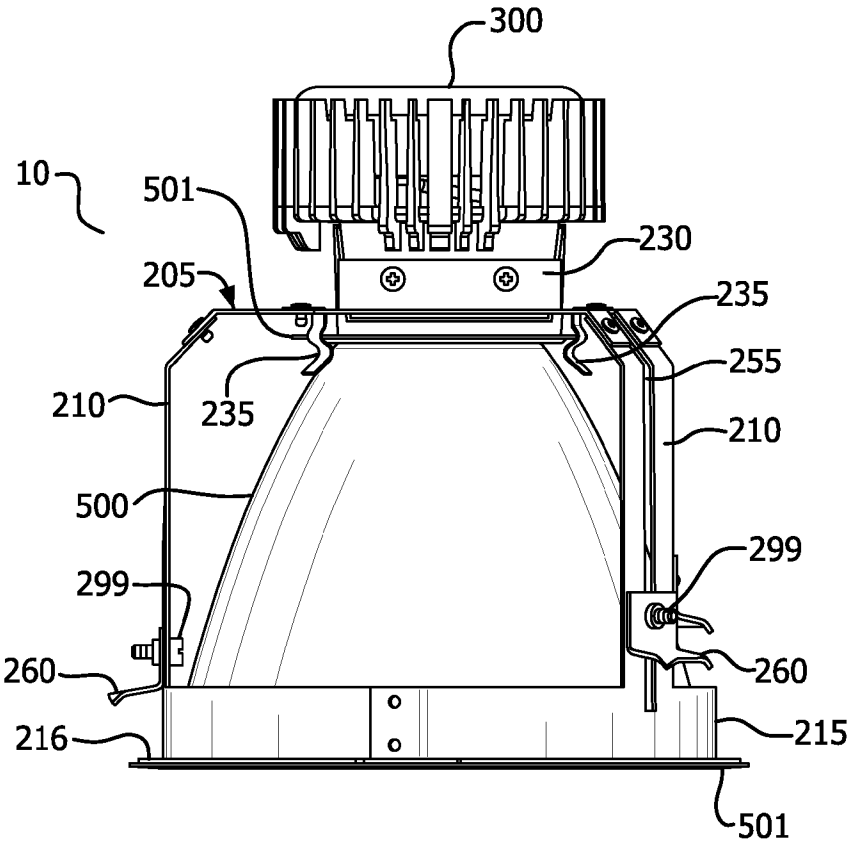
FIG. 2*a* shows an elevation view of the left side of a fixture assembly according to an illustrative embodiment of the invention.
Figure 2C:
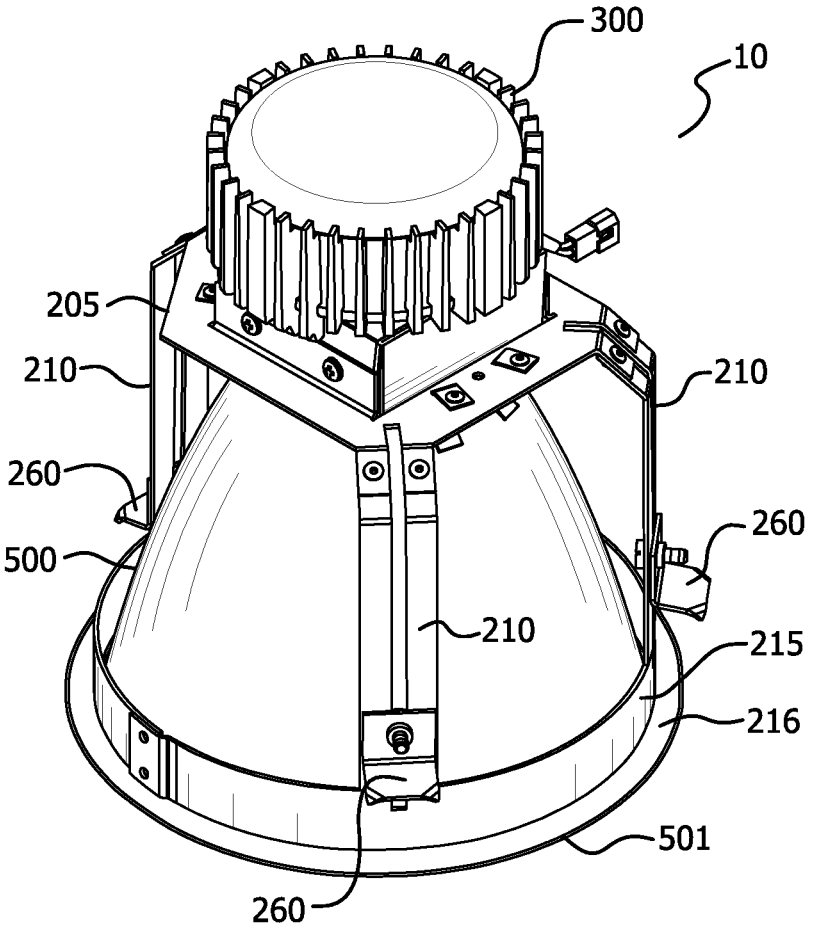
FIG. 2*c* shows a perspective view of the top and rear of the fixture assembly shown in FIG. 2*a*.
Figure 2E:
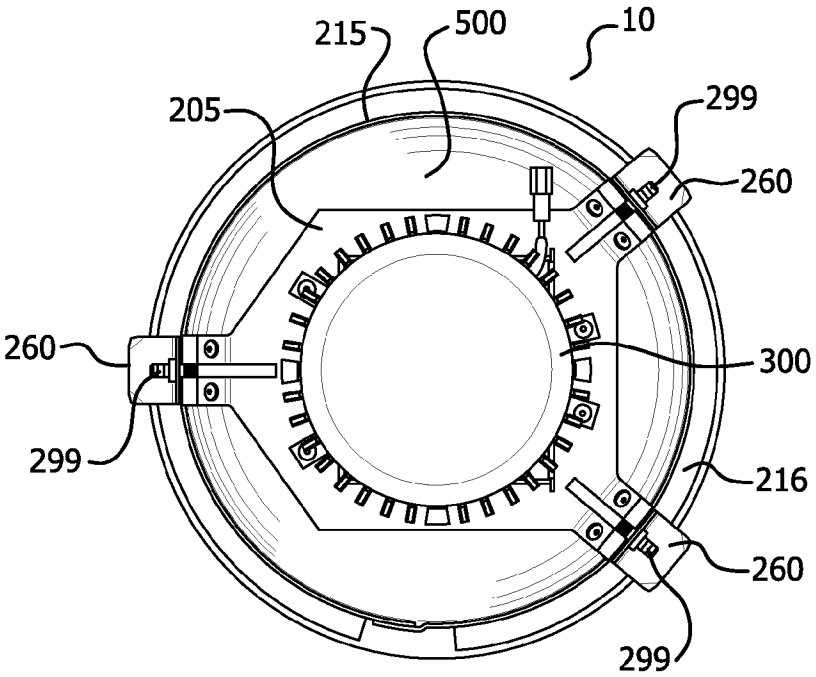
FIG. 2*e* shows a plan view of the top of the fixture assembly shown in FIG. 2*a*.
Figure 2D:
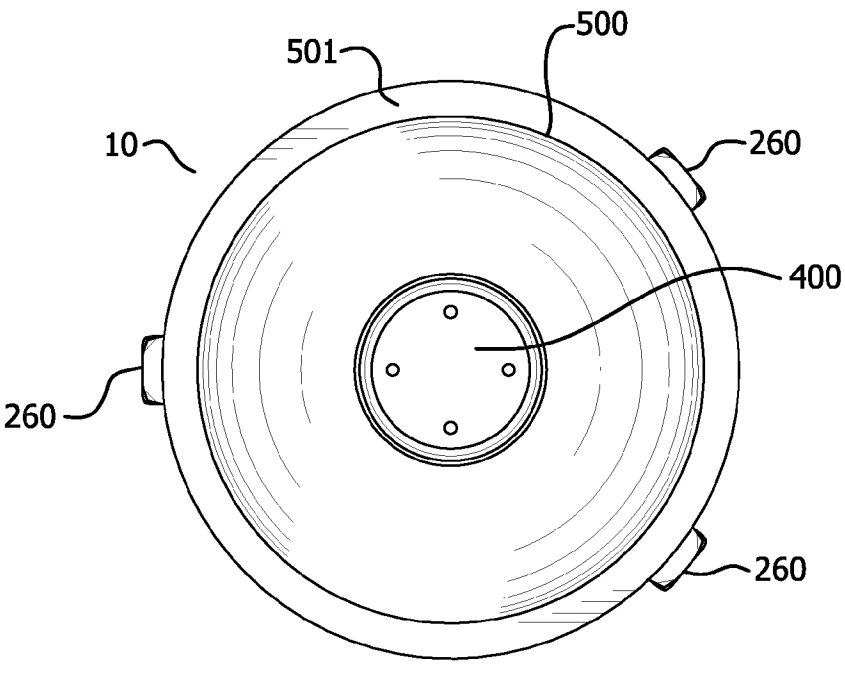
FIG. 2*d* shows a plan view of the bottom of the fixture assembly shown in FIG. 2*a*.
Figure 2F:
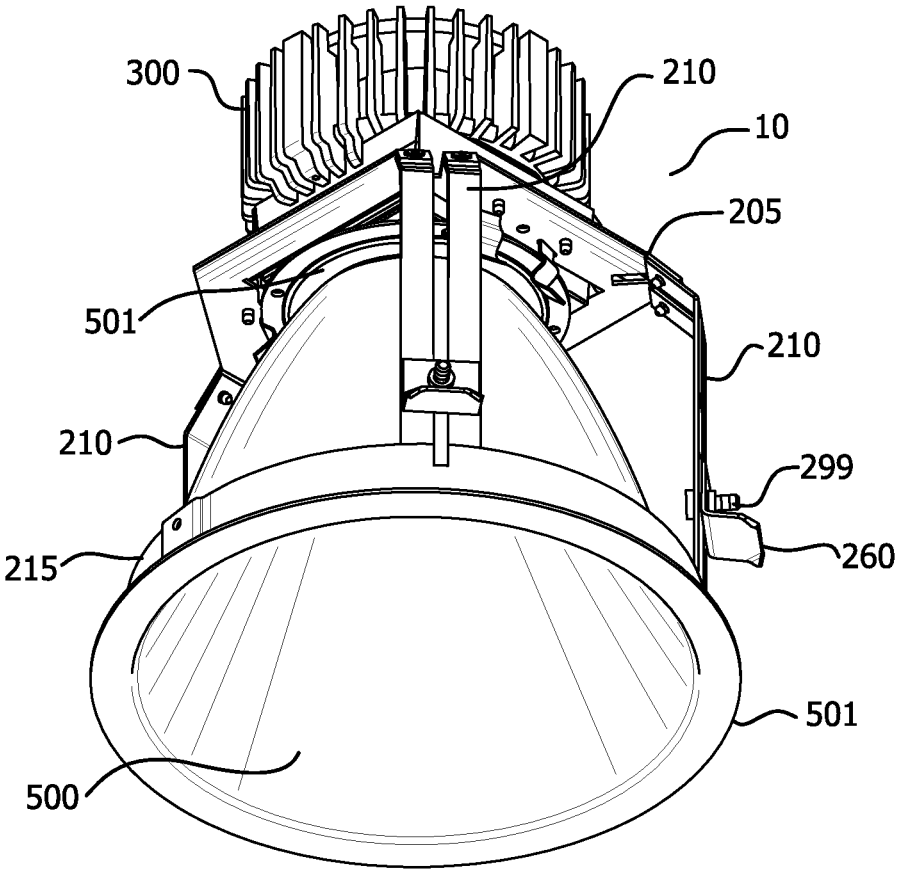
FIG. 2*f* shows a perspective view of the bottom and rear of the fixture assembly shown in FIG. 2*a*.
Figure 2H:
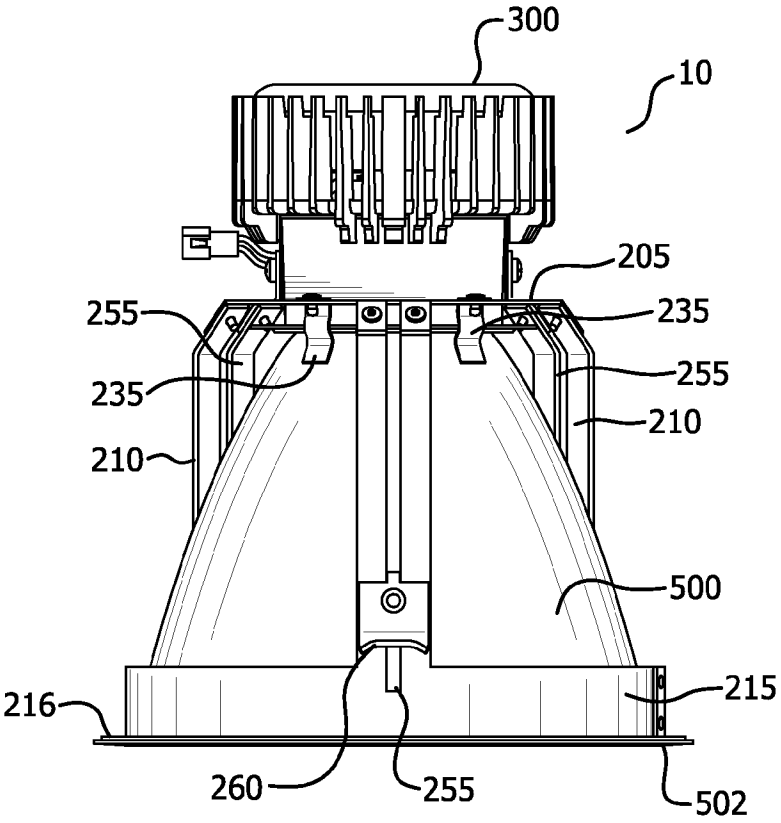
FIG. 2*h* shows an elevation view of the front of the fixture assembly shown in FIG. 2*a*.
Figure 2G:
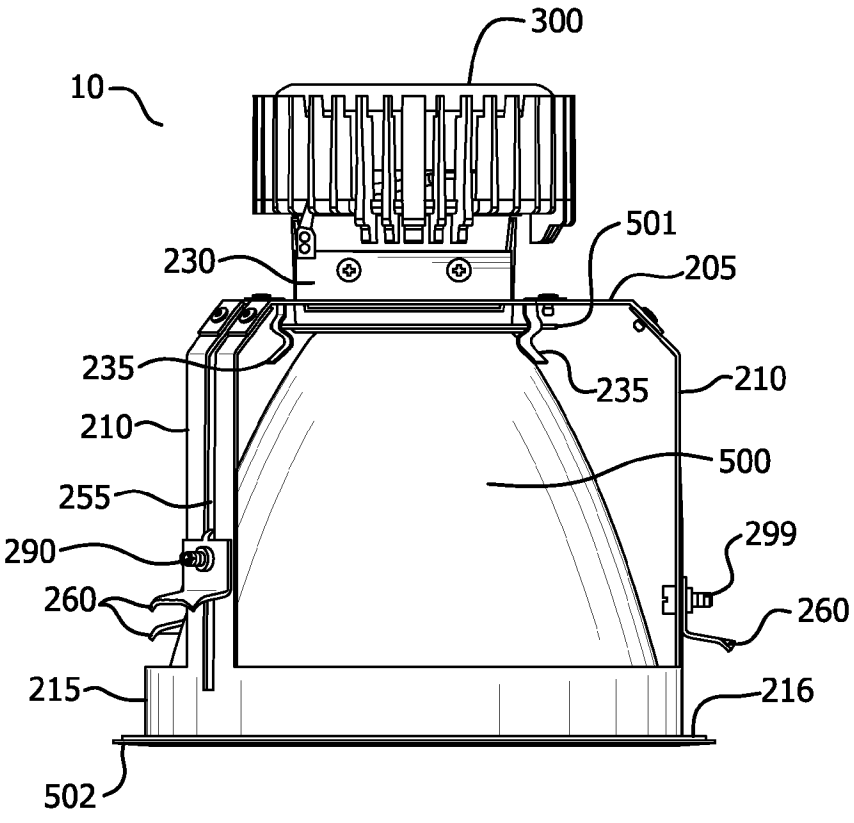
FIG. 2*g* shows an elevation view of the right side of the fixture assembly shown in FIG. 2*a*.
Figure 3B:
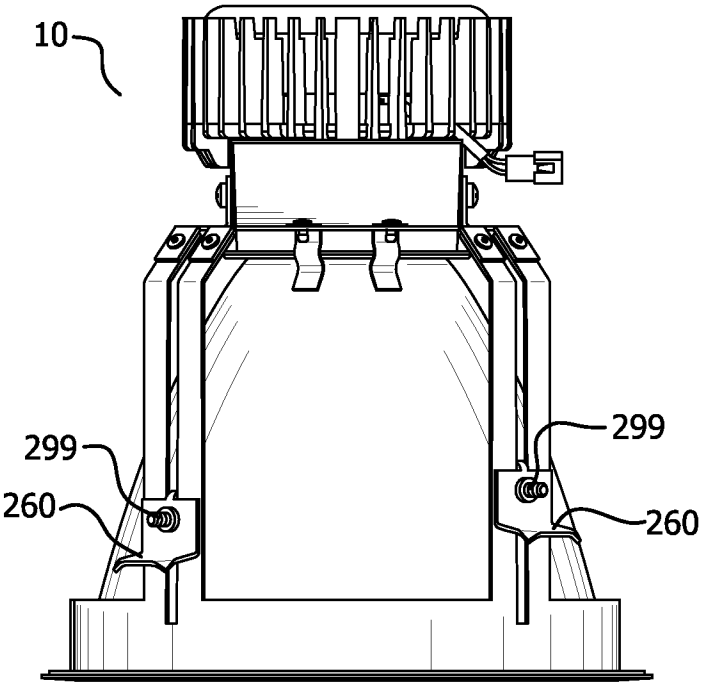
FIG. 3*b* shows an elevation view of the rear side of a fixture assembly having retention clips positioned adjacent the bottom of the assembly
Figure 3A:
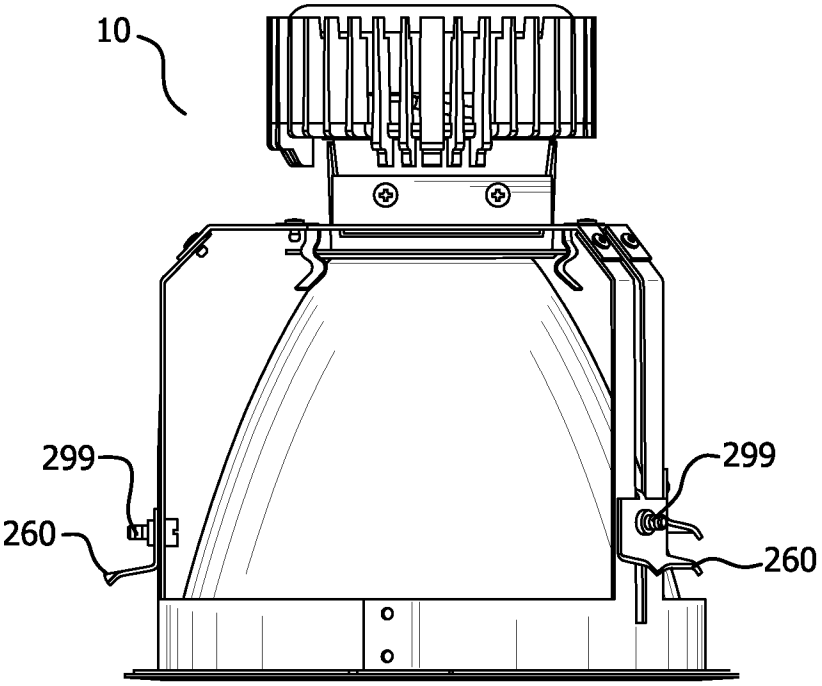
FIG. 3*a* shows an elevation view of the left side of a fixture assembly having retention clips positioned adjacent the bottom of the assembly according to an illustrative embodiment of the invention.
Figure 3D:
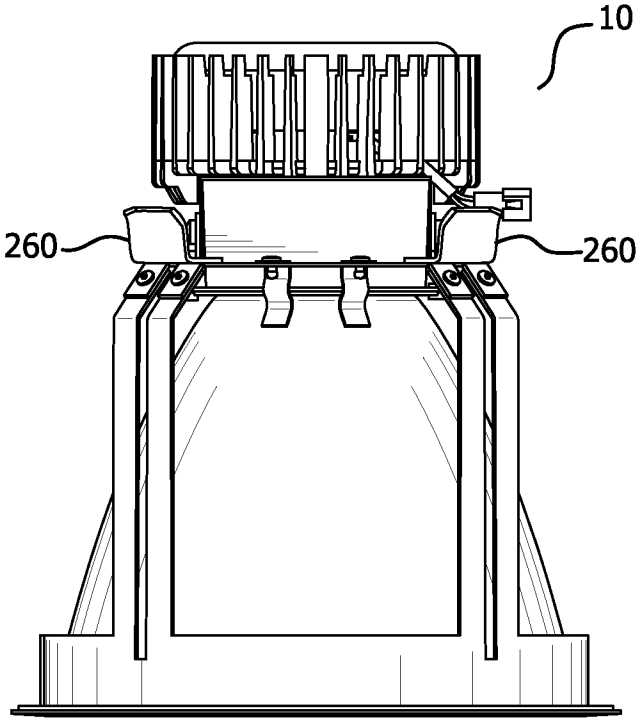
FIG. 3*d* shows elevation views of the rear side of a fixture assembly having retention clips positioned adjacent the top of the assembly shown in FIGS. 3*a* and 3*b*.
Figure 3C:
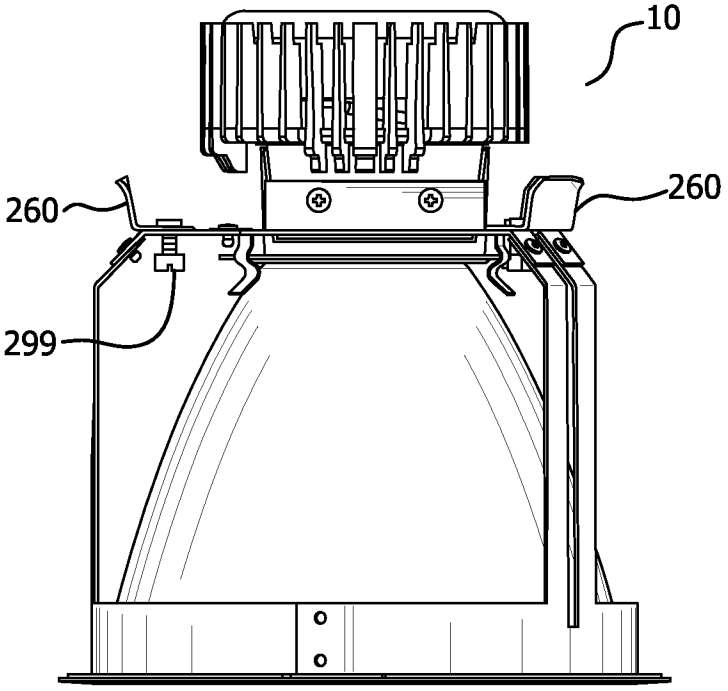
FIG. 3*c* shows an elevation view of the left side of a fixture assembly having retention clips positioned adjacent the top of the assembly shown in FIGS. 3*a* and 3*b*.

In embodiments shown specifically in FIGS. 1*a*-1*d*, multiple rivets are used to secure plate 205 to plurality of support arms 210. In alternative embodiments, other attachment devices can be used to secure plate 205 to support arms 210, e.g., screws, weld joints, or the like. The plurality of support arms 210 shown in FIGS. 1*a*-4*h* consist of three support arms. Any number of support arms 210 may be used without limitation in connection with mounting assembly 200. Each support arm 210 includes slotted communication 255 (also referred to as slot) to guide and control movement of retention clip 260 as shown in FIGS. 1*a*-4*h*, or, alternatively, bracket assembly 1400 as shown for example in FIG. 16. Slot 255 extends from aspects of plate 205 along the length of each support arm 210 to ring 215. Communication 255 may extend into plate 205 and also into ring 215. Communication 255 permits positioning of clip 260 from an upper position adjacent plate 205, as shown in FIGS. 2*c*-2*d*, to lower positions in support arm 210 shown in FIGS. 3*a*-3*b*.

Each retention clip 260 can be secured to its corresponding support arm 210 with fastener 299 that can be partially positioned within slot 255. Fastener 299 is configured to provide a friction fit to secure retention clip 260 to support arm 210. fastener 299 can also be loosened so that it can slide along slot 255 and move the retention clip 260 relative to support arm 210. Fastener 299 can comprise any mechanism that can manipulate (tighten or loosen) a bolt within a corresponding threaded communication of retention clip 260, or that can engage a bolt or the like attached to retention clip 260. For example, fastener 299 can be a thumbscrew (as shown, for example, in FIGS. 1*a*-1*d*), wing nut, or the like. Alternatively, bracket assembly 1400 can be secured to a corresponding support arm 210 as described in greater detail in relation to fixture assembly 1010. Bracket assembly 1400 locks into place and forms a friction fit to secure bracket assembly 1400 to support arm 210.

Referring now to FIGS. 1*a*-4*h*, ring 215 is provided along the lower aspect of mounting assembly 200. As shown, for example, in illustrative embodiments in FIGS. 1*a*-1*d*, ring 215 can be contiguous with support arms 210, but can also be attached as a part to support arms 210 similar to the manner in which plate 205 is attached to the upper portions of support arms 210. Ring 215 includes flange 216 that protrudes away from ring 215 at about 90 degrees as shown specifically in FIGS. 1*a*-1*d*. In an alternative embodiment, flange 216 includes lower portions of support arms 210 that bend at about 90 degrees from the surface of flange 216 and are connected to upper portions of support arms that extend away from plate 205.

Figure 4B:
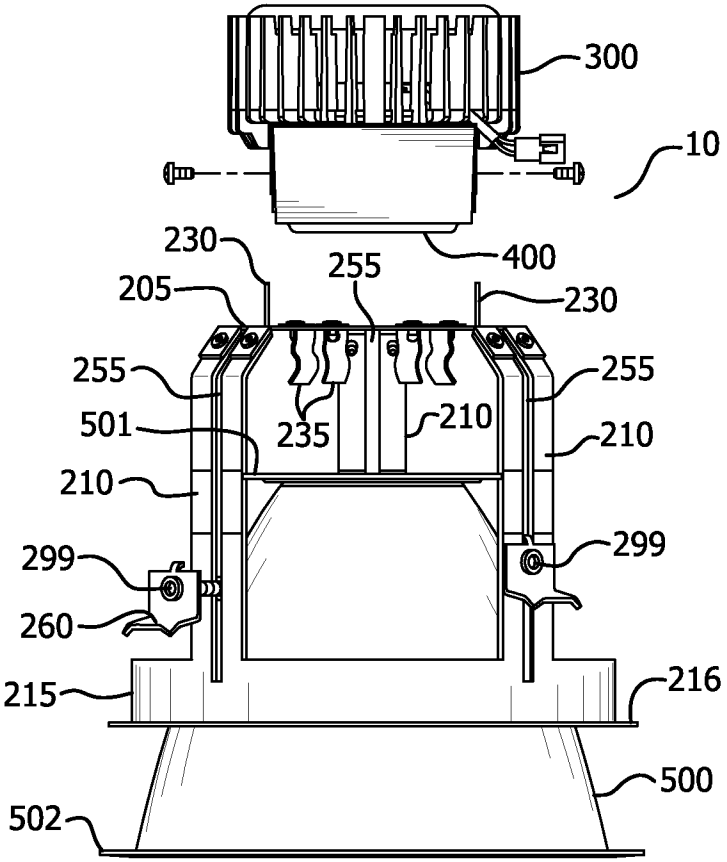
FIG. 4*b* shows an exploded, elevation view of the rear of the fixture assembly shown in FIG. 4*a*.
Figure 4A:
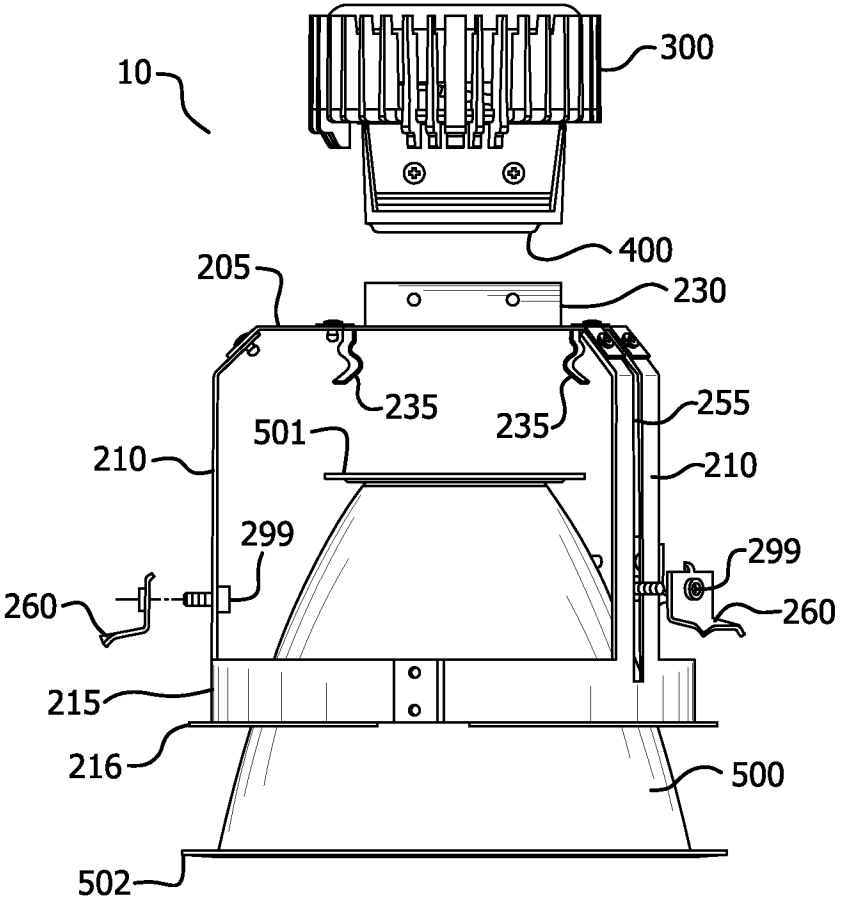
FIG. 4*a* shows an exploded, elevation view of the left side of a fixture assembly according to an illustrative embodiment of the invention.
Figure 4C:
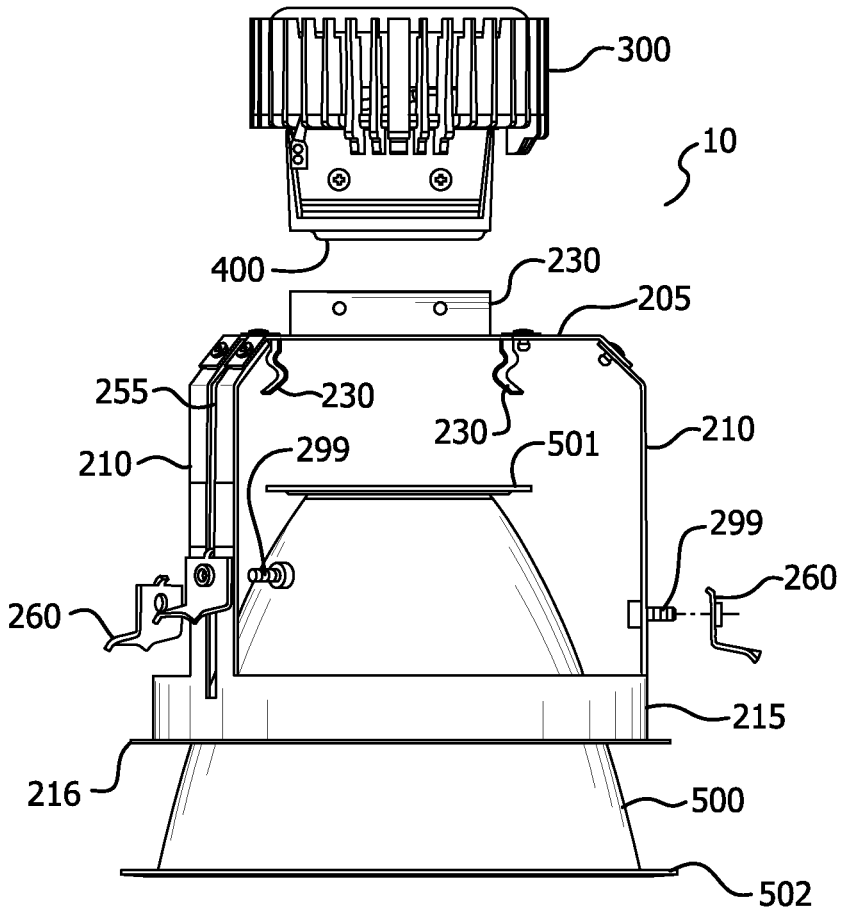
FIG. 4*c* shows an exploded, elevation view of the right side of the fixture assembly shown in FIG. 4*a*.
Figure 4D:
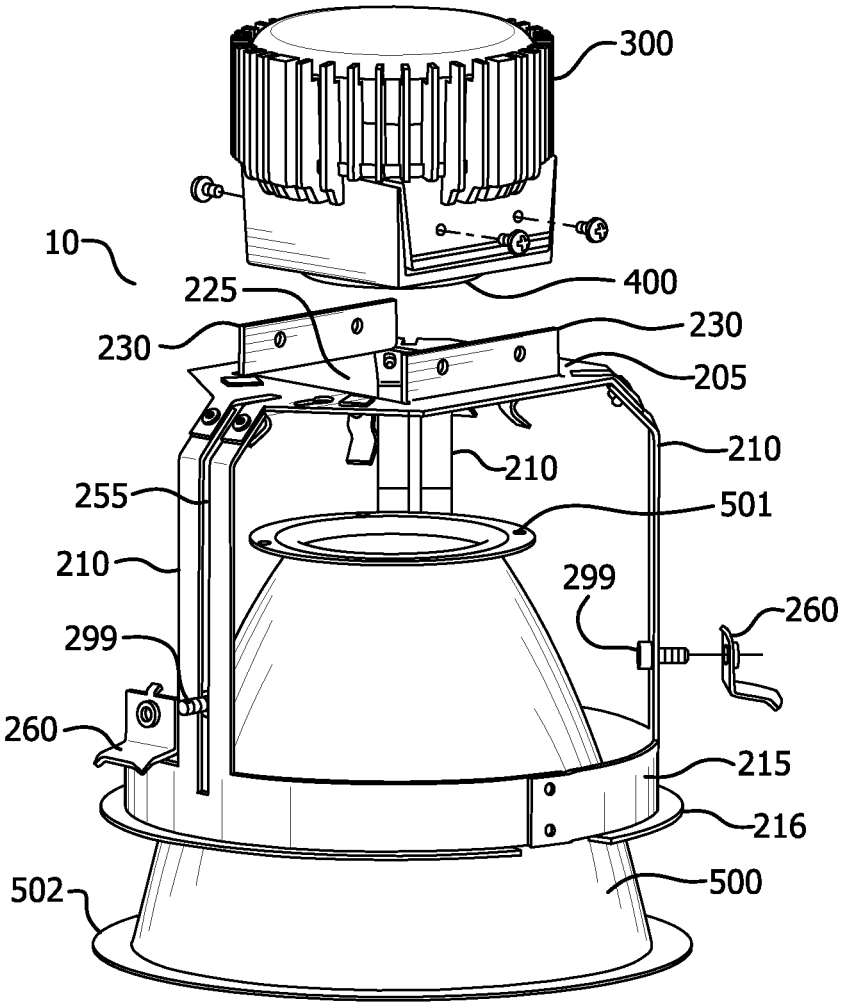
FIG. 4*d* shows an exploded, perspective view of the front and left side of the fixture assembly shown in FIG. 4*a*.
Figure 4E:
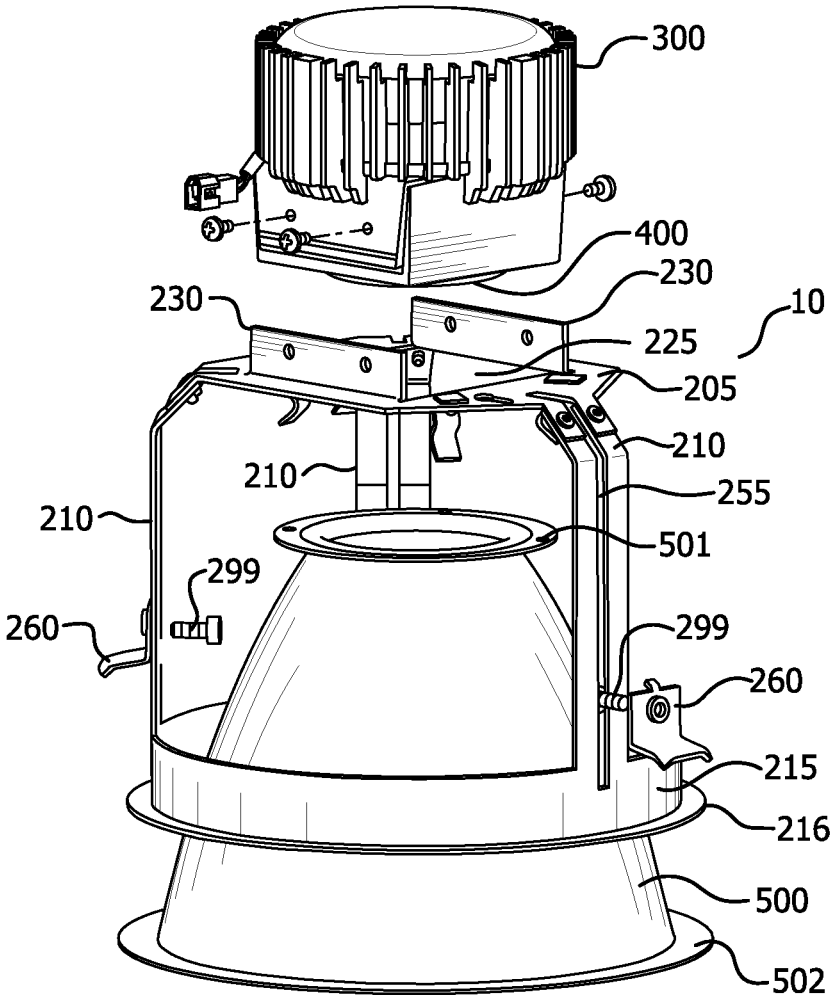
FIG. 4*e* shows an exploded, perspective view of the front and right side of the fixture assembly shown in FIG. 4*a*.
Figure 4F:
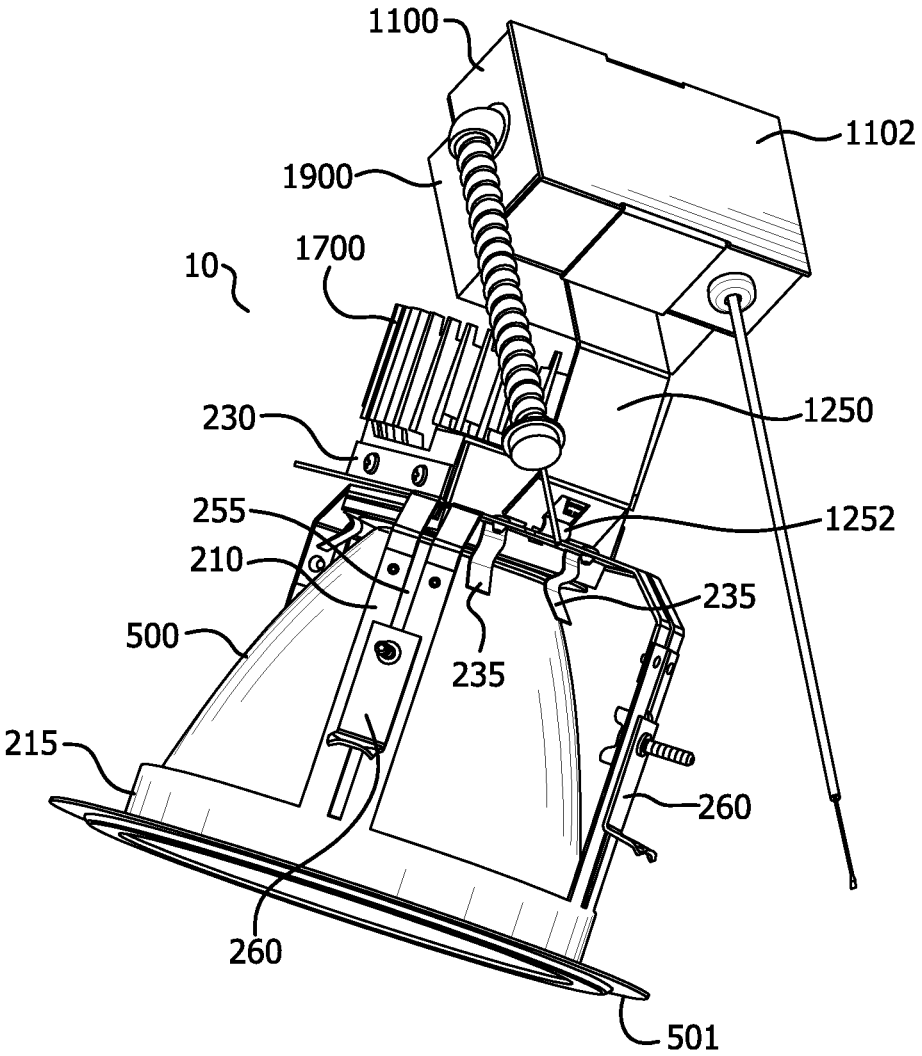
FIG. 4*f* shows a perspective view of another embodiment of the fixture assembly shown in FIG. 4*a*.
Figure 4G:
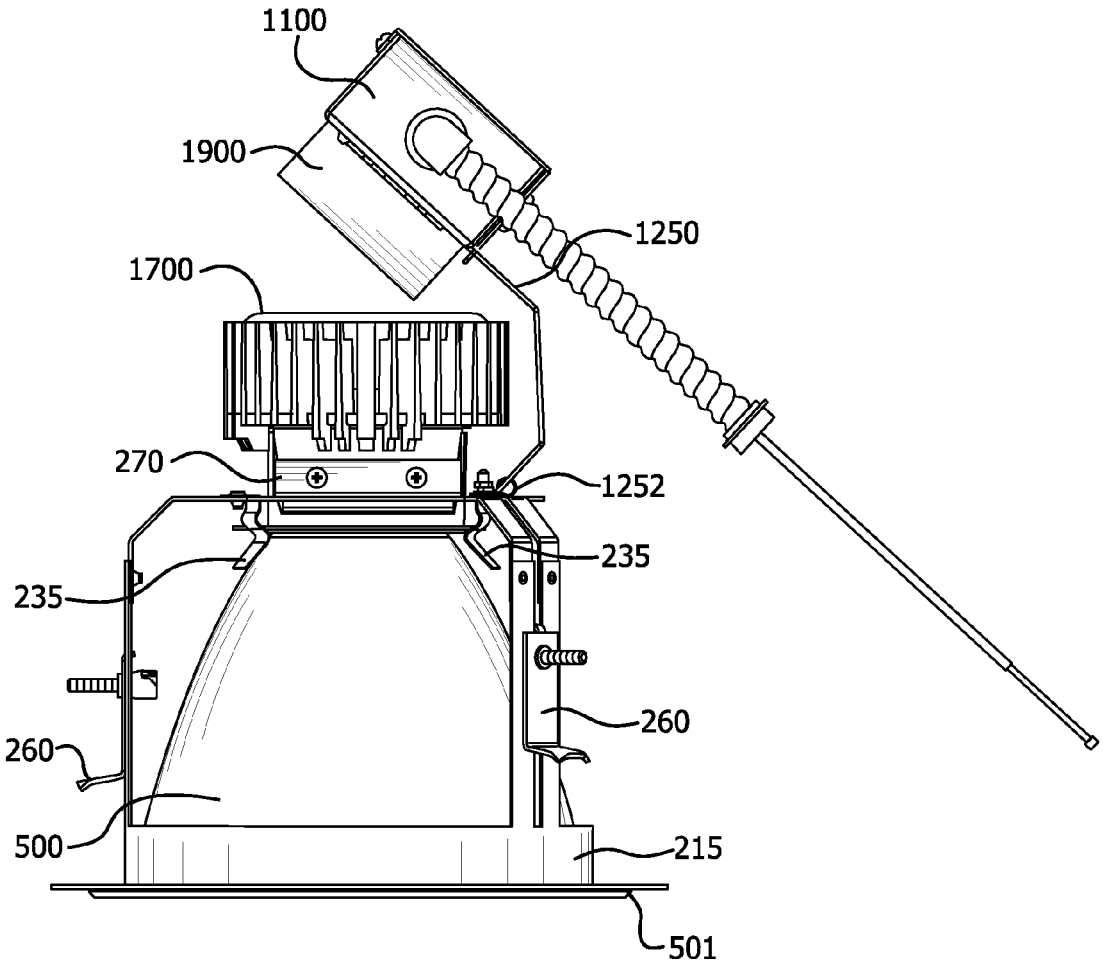
FIG. 4*g* shows an elevation view of the left side of the fixture assembly shown in FIG. 4*f*.
Figure 4H:
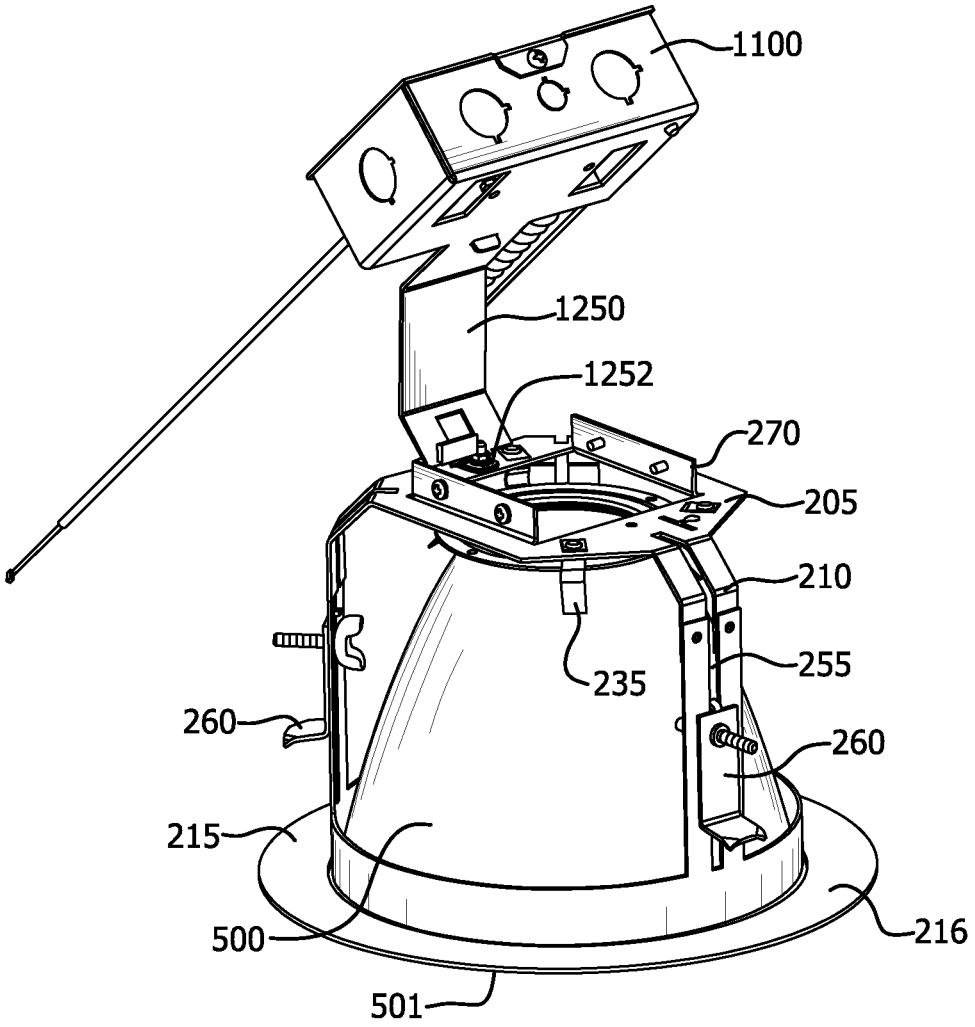
FIG. 4*h* shows a perspective view of the front and right side of the fixture assembly shown in FIG. 4*f* with the light engine and heat sink removed.
Figure 5:
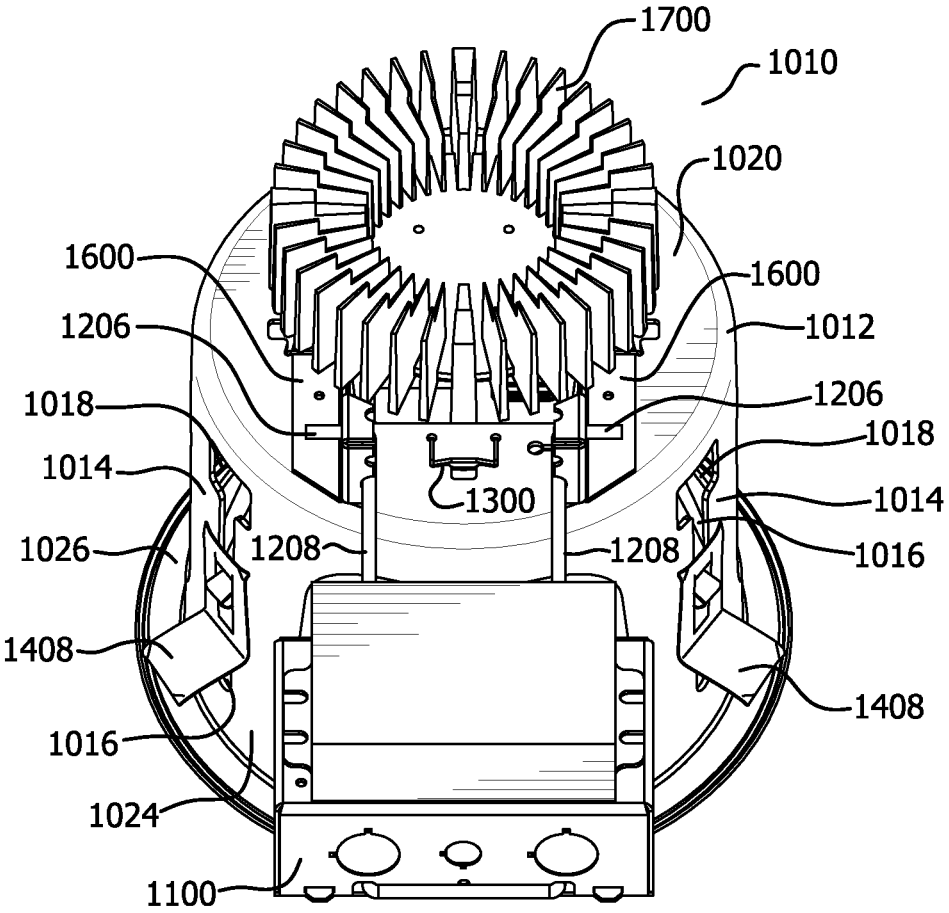
FIG. 5 shows a perspective view of the top and rear of a fixture assembly according to a further embodiment of the invention.

Referring now to FIGS. 4*f*-4*h*, member 1250 is rotatably attached by clip 1252 to plate 205 of mounting assembly 200. Member 1250 permits J-box 1100 to rotate from a vertical position as shown in FIGS. 4*f*-4*h* to a horizontal or other non-vertical position (not shown). Member 1250 may include extension tabs that can be positioned in locking slots in plate 205 to assist in maintaining member 1250 in the vertical position. Member 1250 permits the elevation of J-box 1100 into a position above fixture assembly 10 to facilitate ease in installation as described in further detail in this application. The length of member 1250 can vary to provide clearance for any size of heat sink when member 1250 is positioned in a substantially vertical configuration as shown in FIGS. 4*f*-4*h*. Member 1250 may be used with either fixture assembly 10 or 1010.

Figure 28A:
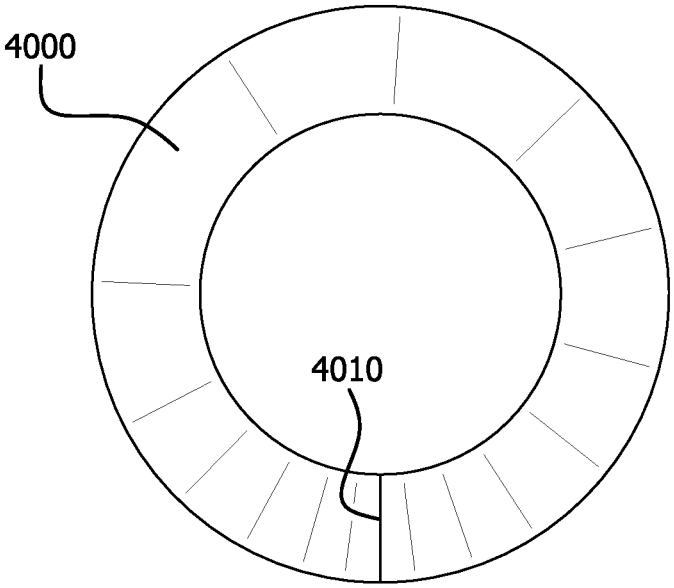
FIG. 28*a* shows a plan view of the top of a remodel ring according to an embodiment of the invention.
Figure 28B:
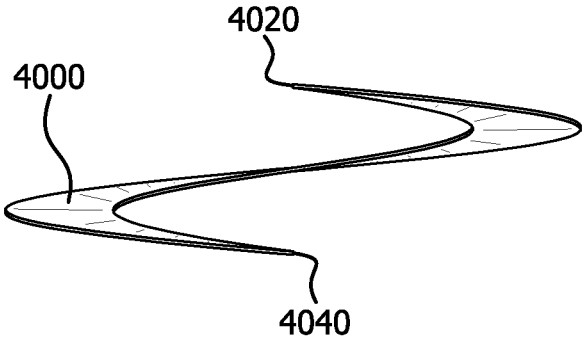
FIG. 28*b* shows a perspective view of the front of remodel ring shown in FIG. 28*a* with portions of the remodel ring deflected along a cut.

The invention also provides processes for installing fixture assembly 10 in new construction and retrofits. Remodeling ring 4000 can be installed by deflecting first edge 4020 from second edge 4040 along cut 4010 as shown in FIGS. 28*a* and 28*b*. With an existing or new rough-in kit, or alternatively, remodeling ring 4000 in place above a ceiling, fixture assembly 10 is prepared for installation. Fastener 299, such as a thumb screw, is loosened so that retention clips 260 can be moved to the upper position shown in FIGS. 3*c*-3*d*. Alternatively, and if bracket assembly 1400 is used, then bracket assembly 1400 is either removed or moved to an upper position to allow insertion of fixture assembly 10 or 1010 through the hole in the ceiling. Member 1250 can be rotated to a vertical position (as shown in FIGS. 4*f*-4*h*) if member 1250 is not already in this vertical position. From below the ceiling, the LED light/LED driver is connected to a new power supply, which can also be referred to as a driver, ballast, control gear, or the like. The power supply is also connected to the existing electrical wires that provide electric service to the LED light. Optionally, a tether such as a wire cable can be connected to both the rough-in kit and fixture assembly 10 or 1010 to assist in holding assembly 10 or 1010 while electrical connections are made.

Fixture assembly 10 is then inserted, J-box 1100 first, through the hole in the ceiling and corresponding hole of the rough-in plate or remodeling ring 4000. Flange 216 of fixture assembly 10 is positioned as close as possible to the hole of the rough-in plate or remodeling ring 4000. In an embodiment, flange 216 may rest against the hole of the rough-in plate or, if present, a cylindrical projection (of the rough-in plate) that defines, in part, the hole of the rough-in plate. In another embodiment, flange 216 may be positioned within the hole in the ceiling, but not in contact with the rough-in plate. In a further embodiment, flange 216 may be positioned flush with the exposed surface of the ceiling.

With fixture assembly 10 in place, retention clips 260 or bracket assemblies 1400 are slid along slot 255 to a lower position (e.g., shown in FIGS. 3*a*-3*b*) to contact the upper surface of the rough-in plate or remodeling ring 4000. If using retention clips 260, then fasteners 299 for retention clips 260 are tightened. This secures each clip 260 in place on support arms 210, and, consequently, fixture assembly 10 in place adjacent the rough-in kit or remodeling ring 400 and the ceiling. Alternatively, and if using bracket assemblies 1400, then lever arm 1404 is snapped closed into a locked position on supports arms 210.

Reflector 500 is inserted through ring 215. Reflector 500 is pressed upwards so that its upper rim 501 engages indentations of deflection clips 235 shown, for example, in FIGS. 3*a*-3*b* or torsion springs 1300. Deflection clips 235 or torsion springs 1300 secure reflector 500 to fixture assembly 10. When reflector 500 is secured in place with an installed fixture assembly, the reflector's lower rim 502 may contact the surface of the ceiling or tiles or bottom surface of flange 216. It is recognized that this installation process can be modified for various conditions of new construction and retrofitting existing structures.

Another illustrative embodiment of the invention is fixture assembly 1010 depicted throughout FIGS. 5-27*c*. This assembly 1010 comprises housing 1012. In one embodiment, housing 1012 is shown in FIGS. 5-20 as a monobody having top platform 1020 connected by vertical supports 1014 to ring 1024 having flange 1026. In alternative embodiments, housing 1012 may be formed from one or more parts attached together by fittings such as, for example, rivets. Housing 1012 is the main infrastructure of fixture assembly 1010.

Figure 12:
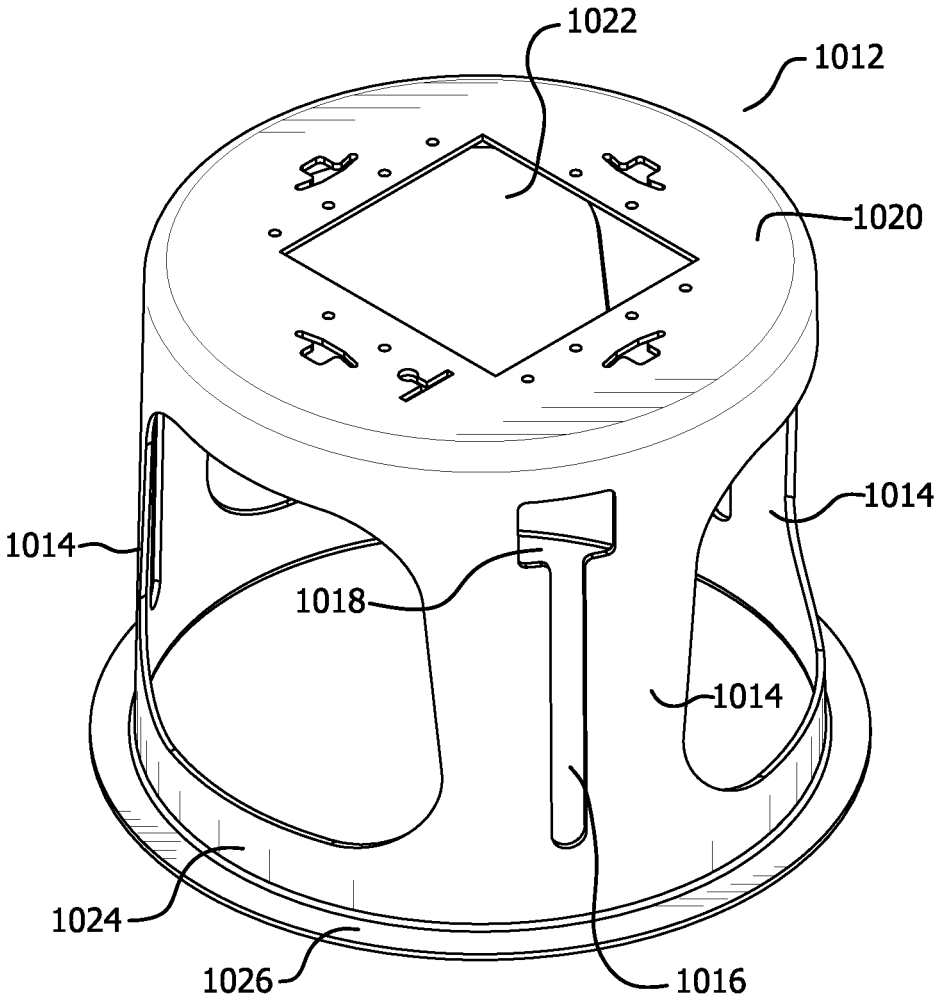
FIG. 12 shows a perspective view of the top and front of the housing shown in FIG. 5.
Figure 13:
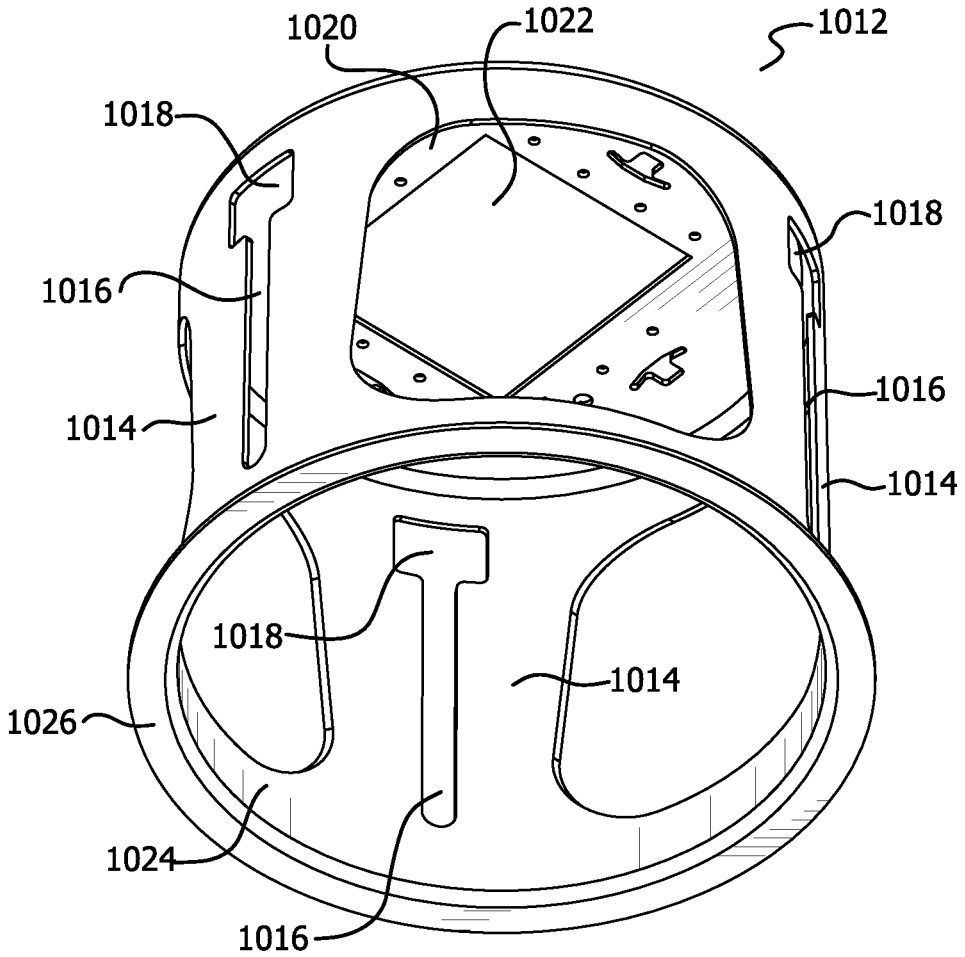
FIG. 13 shows a perspective view of the bottom and rear of the housing shown in FIG. 12.
Figure 14:
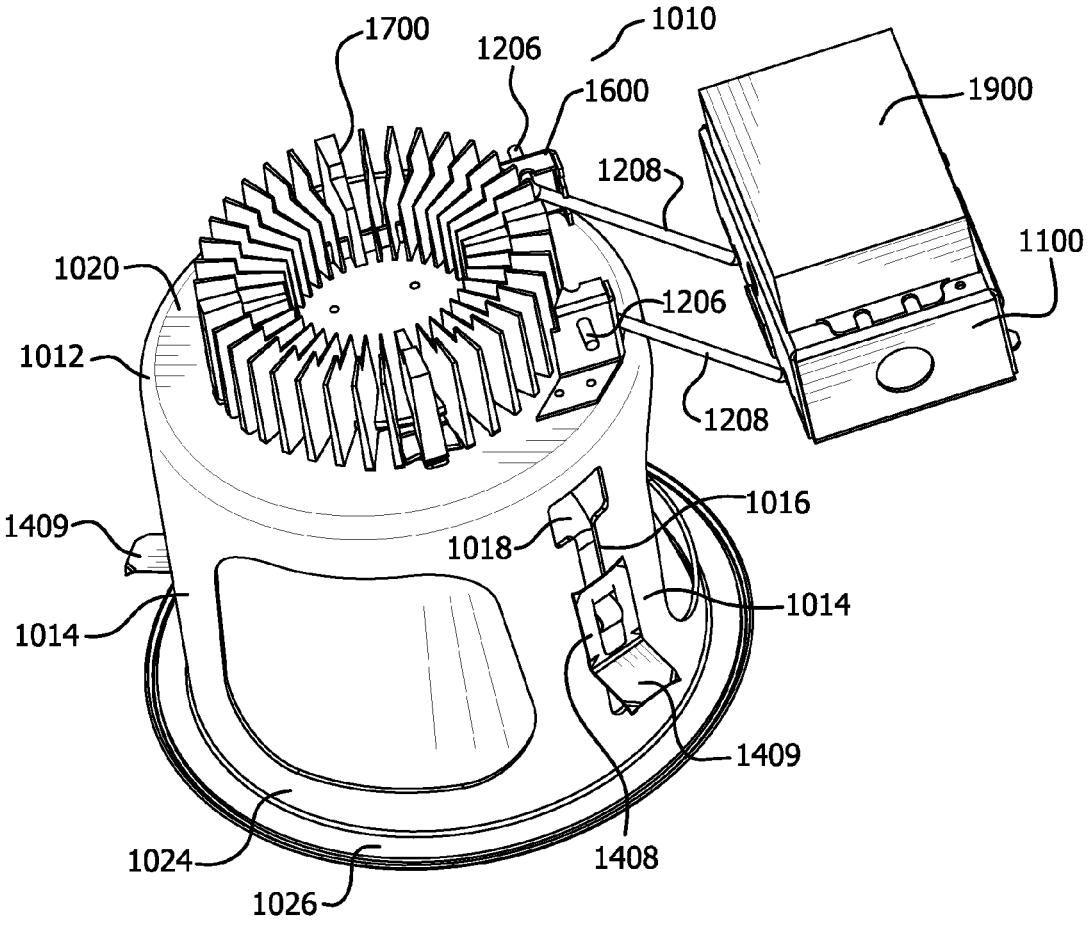
FIG. 14 shows a perspective view of the top and left side of a fixture assembly according to an even further embodiment of the invention.
Figure 15:
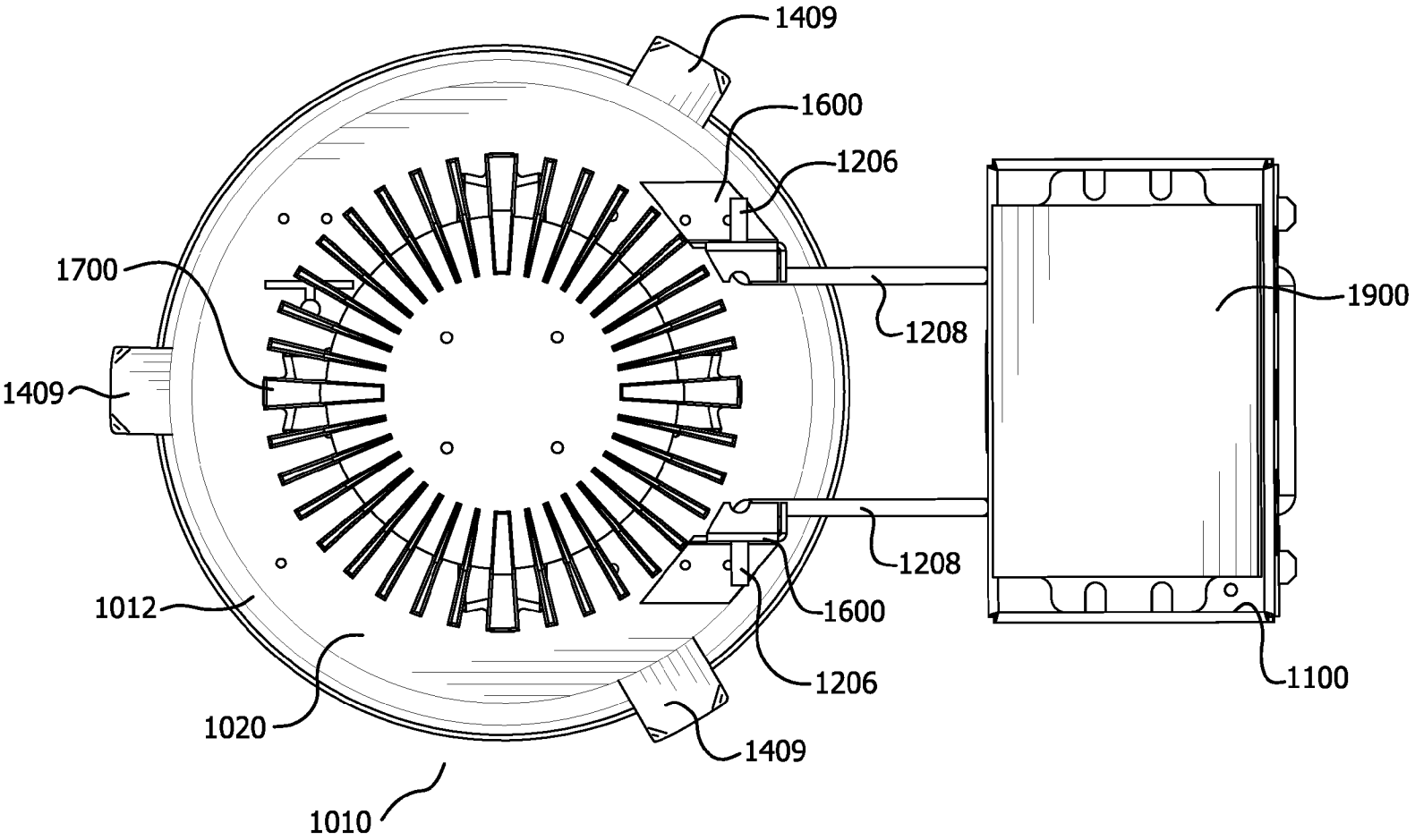
FIG. 15 shows a plan view of the top of the fixture assembly shown in FIG. 14.

Referring now to FIGS. 12 and 13, several communications are provided with housing 1012 for different purposes. Light communication 1022 is provided in top platform 1020 to permit the passage of light from an LED light positioned adjacent top platform 1020. While illustrated as a square, the geometric shape of light communication 1022 may comprise any suitable geometric shape, e.g., round, oval, triangular, rectangular, etc.

Openings 1018 are also provided near the top of each vertical support 1014 as shown, for example, in FIGS. 8-10, 12-13, and 16-18. Openings 1018 provide passage for bracket assembly 1400 to be installed in slots 1016 of housing 1012. For example, and with bracket assembly 1400 in a released position, latch 1402 can be passed through opening 1018 from the outside of housing 1012. Alternatively, bracket 1408 can be passed through opening 1018 from the inside of housing 1013. In either instance, bracket 1408 rests on the outside surface of vertical support 1014 and latch 1402 rests on inner surface of vertical support 1014. Latch's tongue 1405 and portions of bracket's support surface 1411 communicate through slot 1016.

Slot 1016 is provided vertically and centrally along each vertical support 1014 shown specifically in FIGS. 12 and 13. Slot 1016 extends from opening 1018 running along vertical support 1014 and terminates above ring 1024. Slot 1016 guides bracket assembly 1400, which when in a released position, slides along vertical support 1014. Alternatively, retention clips 260 can be used as described in relation to fixture assembly 10.

Referring to FIGS. 24*a-c*, 25*a-c*, 26*a-c*, and 27*a-c*, bracket assembly 1400 comprises latch 1402 hinged together with bracket 1408. Latch 1402 comprises tongue 1405 and lever arm 1404. Tongue 1405 is configured to contact and interact with support surface 1411 of bracket 1408 while locking bracket assembly 1400 in place on vertical support 1014. The purpose of lever arm 1404 is to removeably secure bracket 1408 to vertical support 1014. Bracket assembly 1400 is configured for use within slot 1016 as shown, for example, in FIGS. 6 and 14, and is used to install fixture assembly 1010 as described in detail in this application. Bracket assembly 1400 (e.g., preinstalled or installed after inserting fixture assembly 10 or 1010 through hole in ceiling) can also be used with slot 255 as shown in FIGS. 2*a* through 4*h*.

Operation of bracket assembly 1400 can occur without tools and without fasteners. For example, lever arm 1404 is shown in a released position in FIGS. 24*a*, 25*a*, 26*a*, and 27*a*. Lever arm 1404 can be pressed upward relative to bracket 1408. As lever arm 1404 is rotated upward, teeth 1406 of lever arm 1404 contact with and removeably imbed within an inner surface of vertical support 1014. Embedded teeth 1406 function as a leverage point for locking and unlocking bracket assembly 1400. Latch 1402 interconnects with bracket 1408 so that latch 1402 can partially rotate (about 180 degrees) along an axis that is generally perpendicular to the vertical alignment of bracket 1408.

Figure 9:
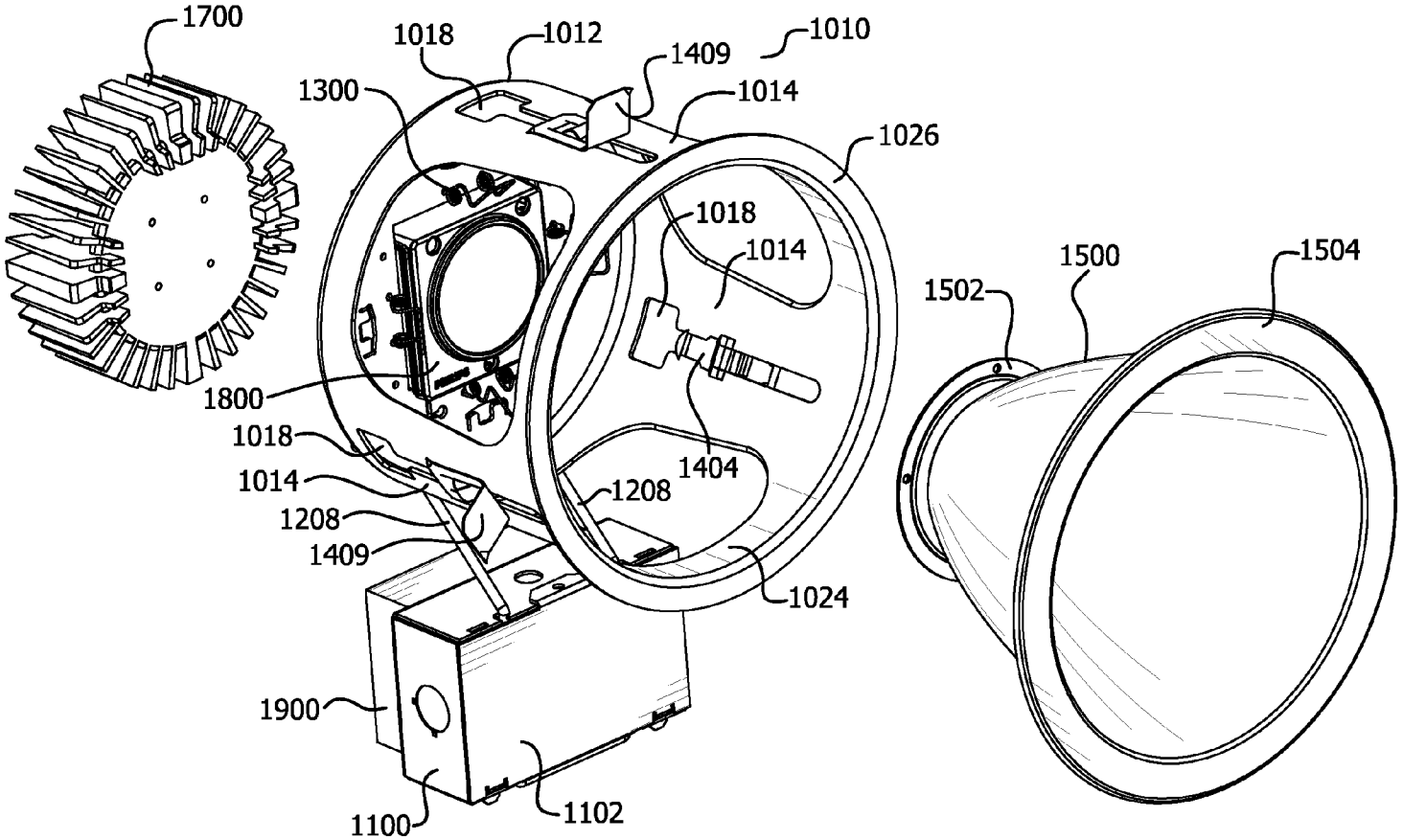
FIG. 9 shows a partially-exploded, perspective view of the bottom and right side of the fixture assembly shown in FIG. 5.
Figure 10:
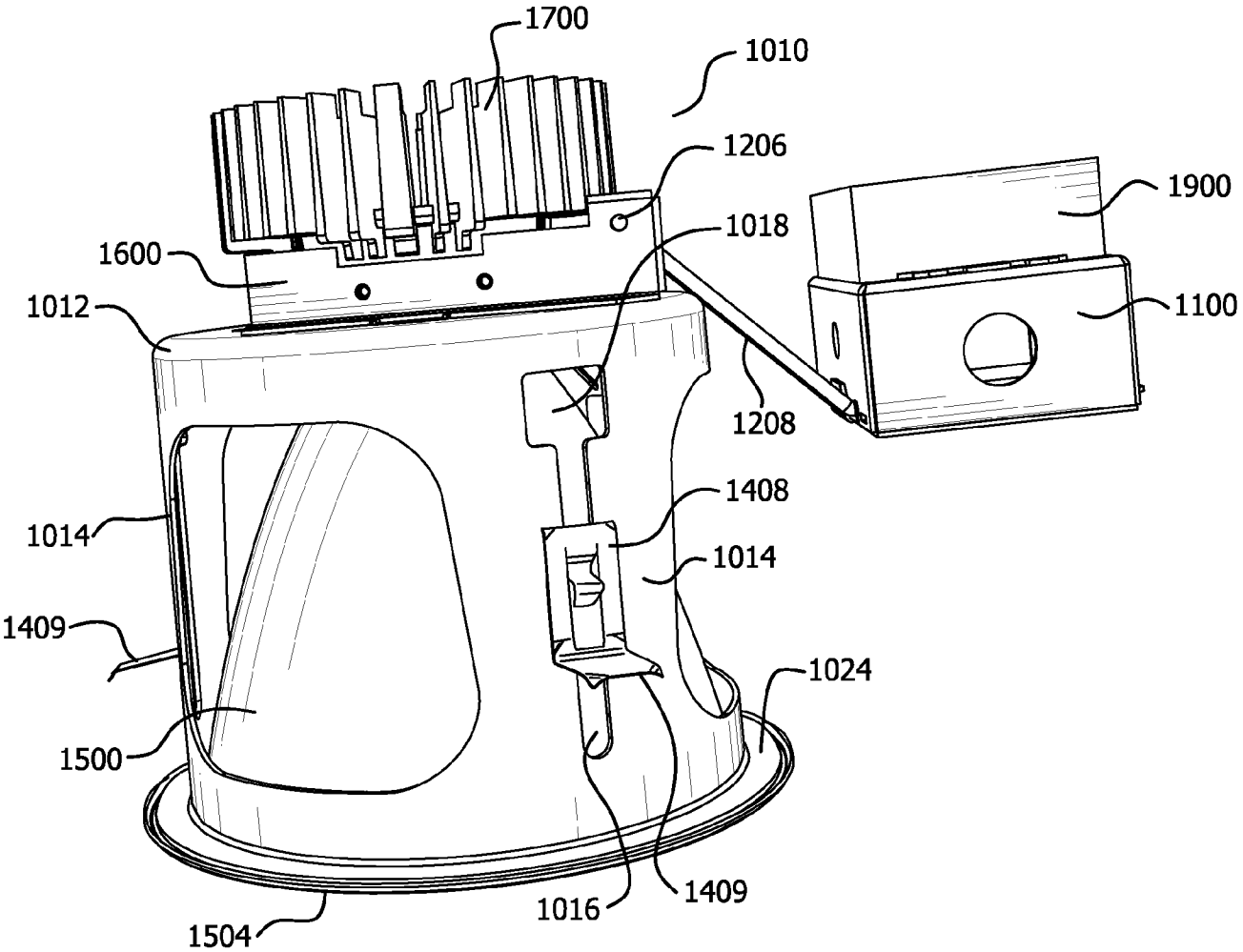
FIG. 10 shows a perspective view of the left side of the fixture assembly shown in FIG. 5.
Figure 11:
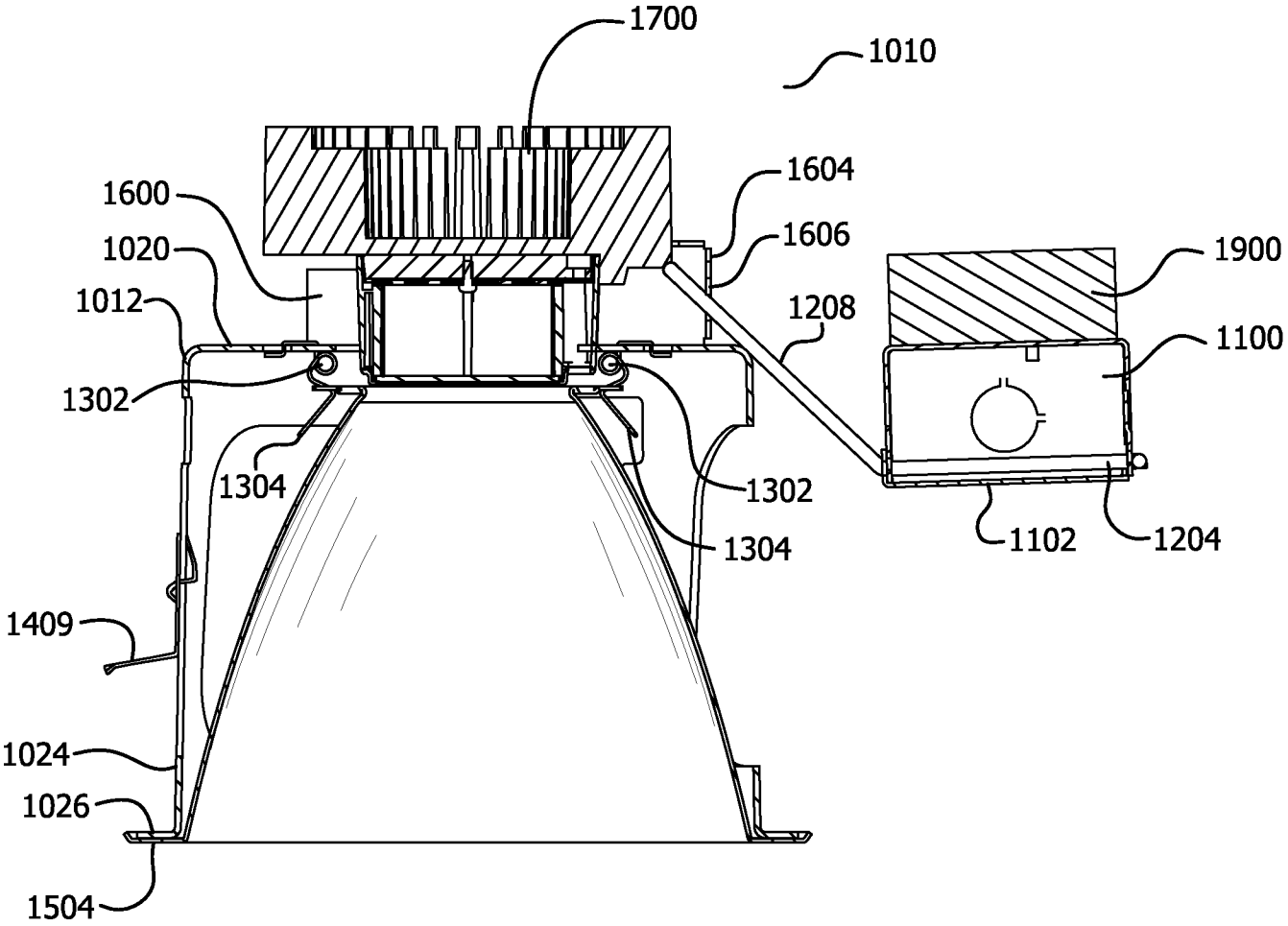
FIG. 11 shows a sectional view of the fixture assembly shown in FIG. 5.
Figure 18:
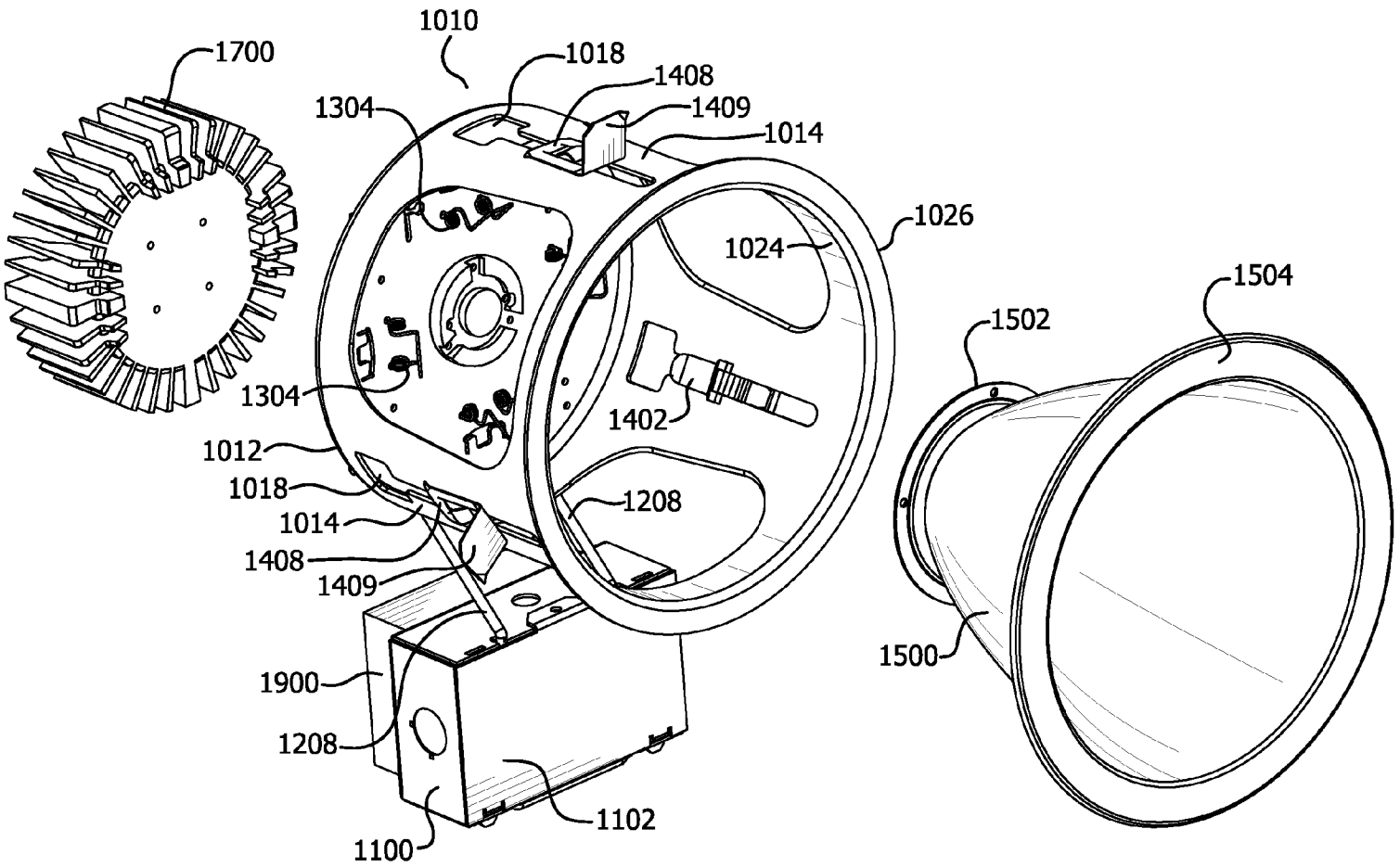
FIG. 18 shows a partially-exploded, perspective view of the bottom and right side of the fixture assembly shown in FIG. 14.
Figure 19:
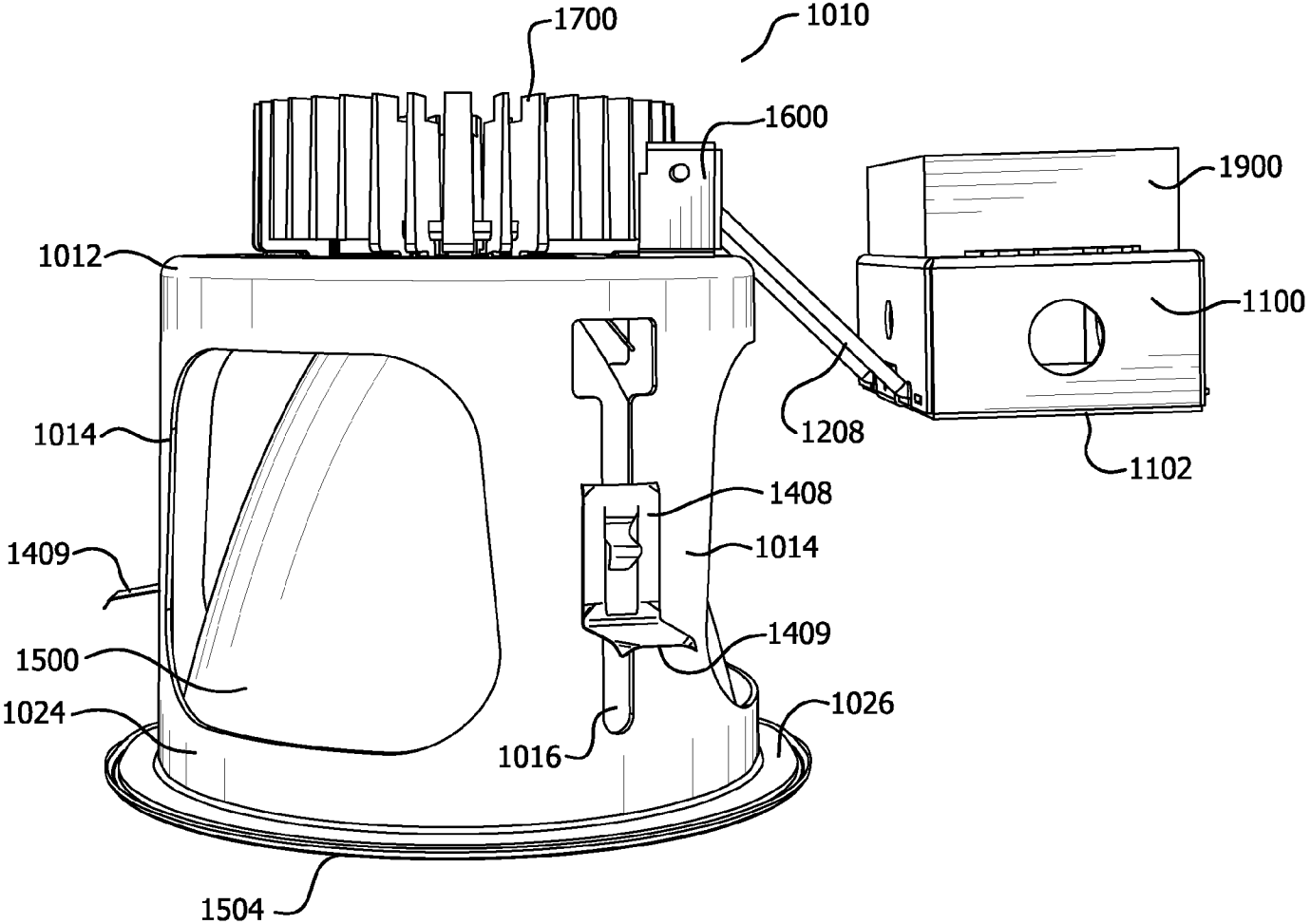
FIG. 19 shows a perspective view of the left side of the fixture assembly shown in FIG. 14.
Figure 20:
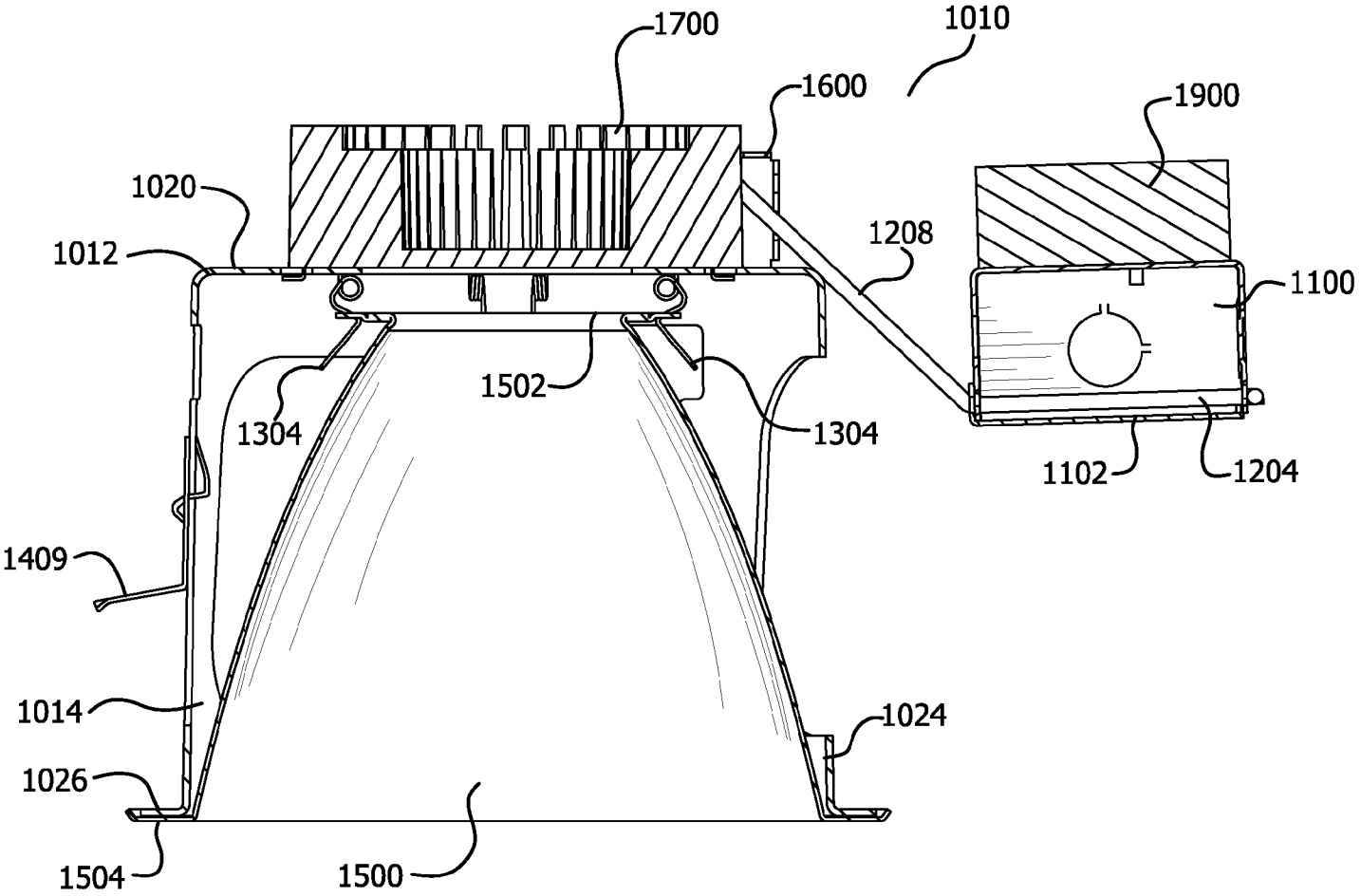
FIG. 20 shows a sectional view of the fixture assembly of FIG. 14.
Figure 21:
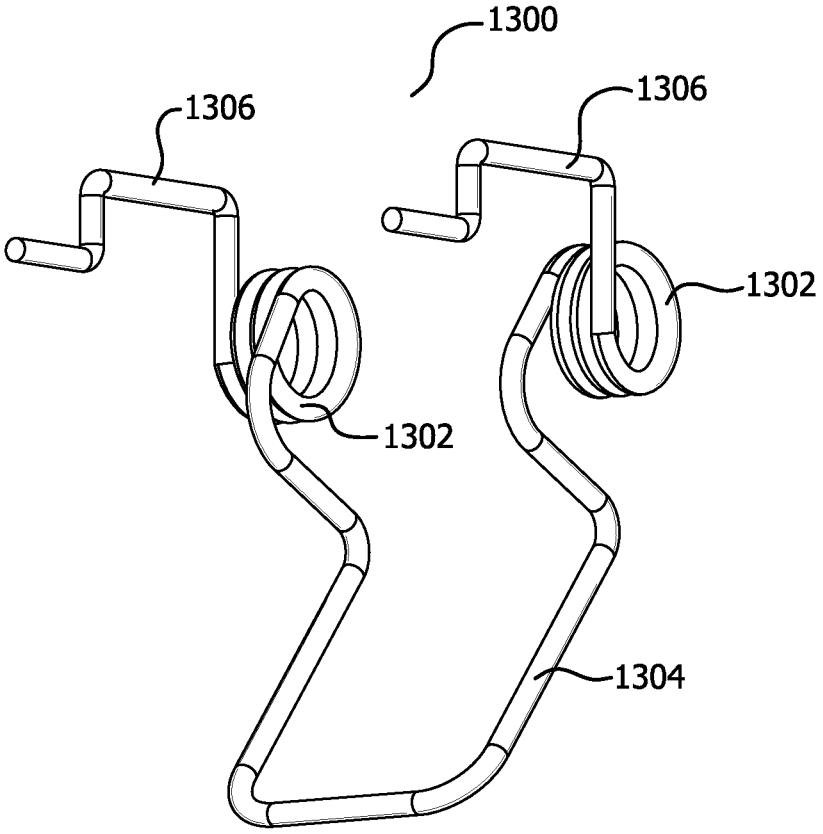
FIG. 21 shows a perspective view of a torsion spring according to an embodiment of the invention.

Referring now to FIGS. 24*b*, 24*c*, 25*b*, 25*c*, 26*b*, 26*c*, 27*b*, and 27*c*, moving lever arm 1404 upward causes tongue 1405 to push downward on support surface 1411 of bracket 1408. Consequently, and with teeth 1406 imbedded into inner surface of vertical support 1014, tongue 1405 pushes bracket 1408 in a downward direction. As lever arm 1404 is moved further upward as shown in FIGS. 24*c*, 25*c*, 26*c*, and 27*c*, tongue 1405 pushes bracket 1408 further down to relative to support arm 1014. Tongue 1405 eventually passes a geometric high point and snaps lever arm 1404 into a locked position against vertical support 1014 as shown in FIGS. 9 and 18. In this locked position, vertical support 1014 is sandwiched between bracket 1408 and lever arm 1404 thereby creating a friction fit.

Figure 23:
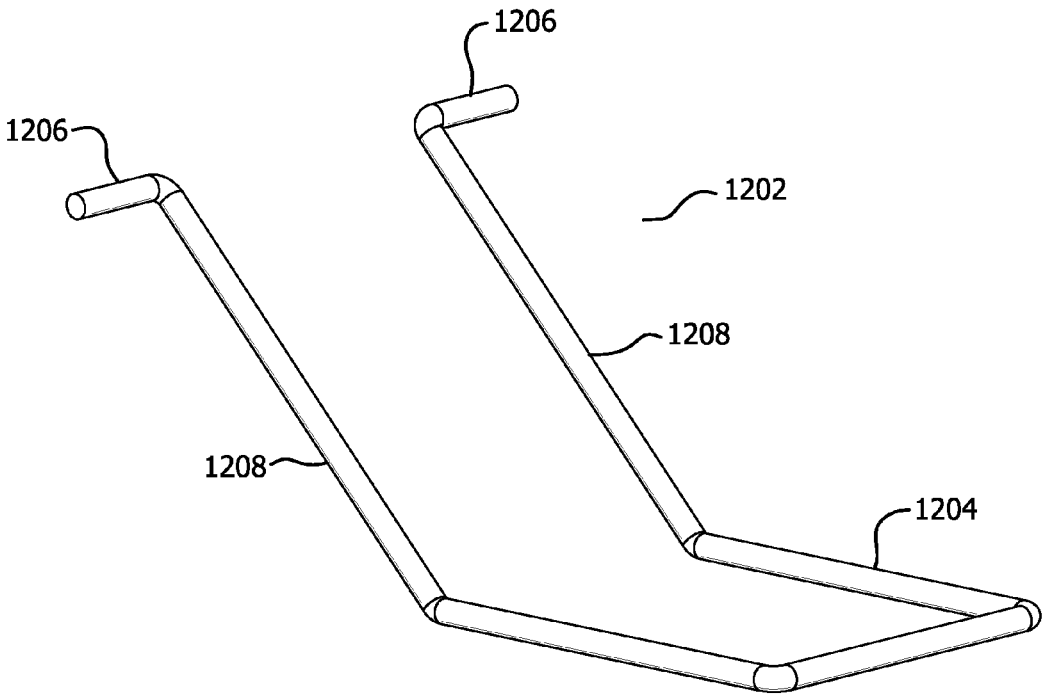
FIG. 23 shows a perspective view of a wire form assembly according to an embodiment of the invention.
Figure 24A:
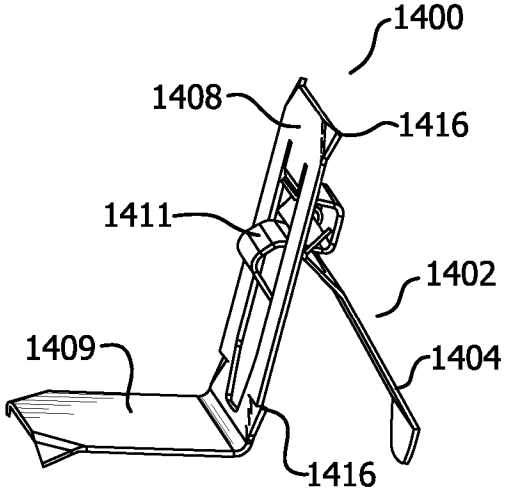
FIGS. 24*a*, 24*b*, and 24*c* show perspective views of the left side of a bracket assembly according to an embodiment of the invention.
Figure 24B:
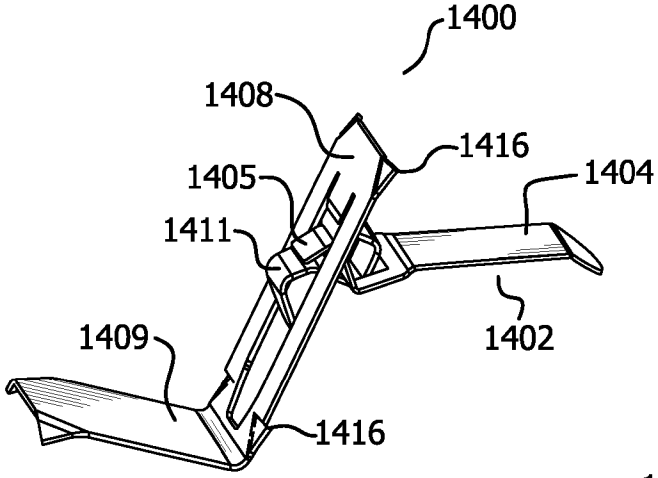
Figure 24C:
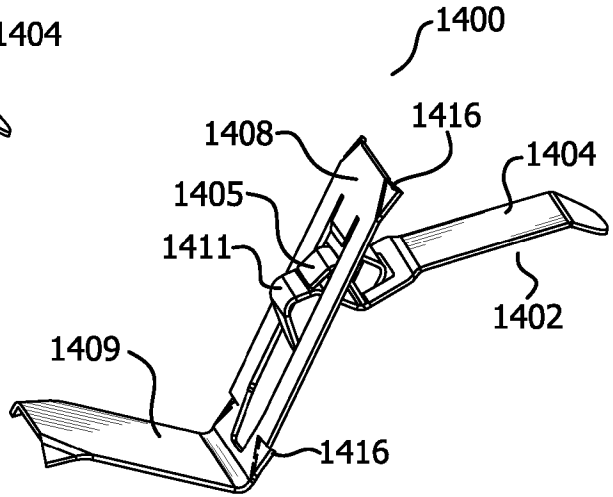
Figure 25C:
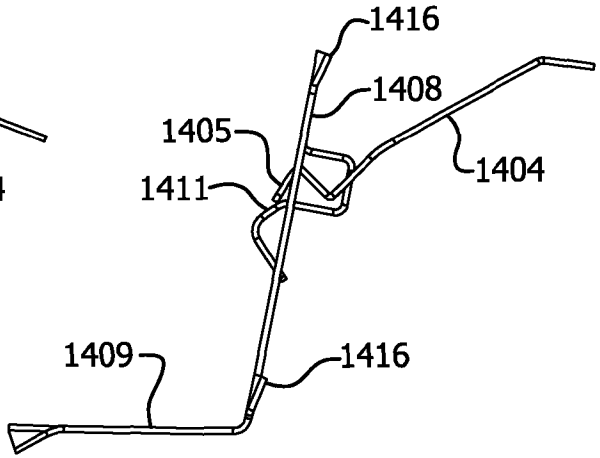
FIGS. 25*a*, 25*b*, and 25*c* show elevation views of the left side of the bracket assembly shown in FIGS. 24*a*, 24*b*, and 24*c*.
Figure 25B:
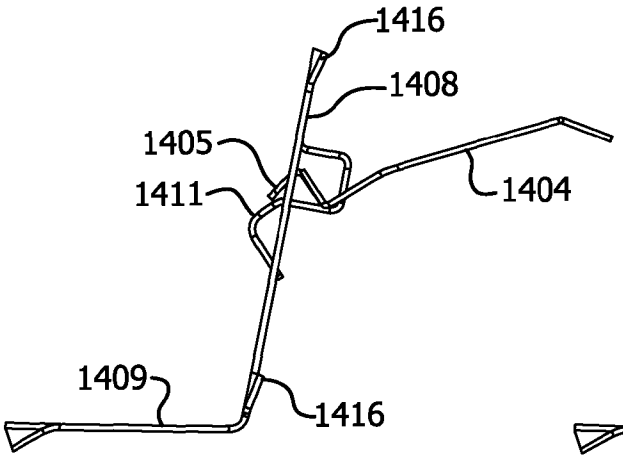
Figure 25A:
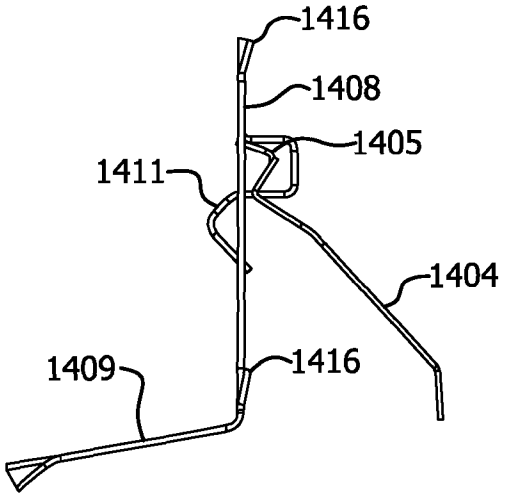
Figure 26C:
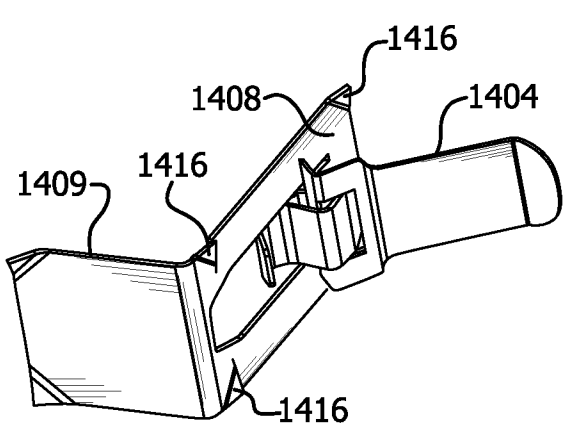
FIGS. 26*a*, 26*b*, and 26*c* show perspective views of the bottom and left sides of the bracket assembly shown in FIGS. 24*a*, 24*b*, and 24*c*.
Figure 26B:
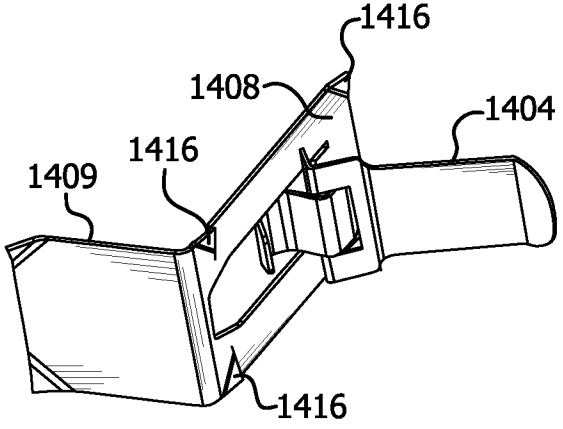
Figure 26A:
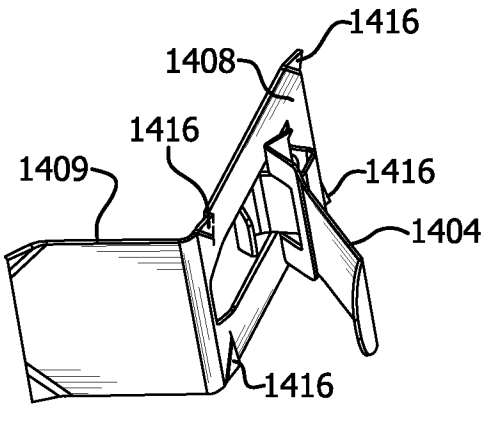
Figure 27C:
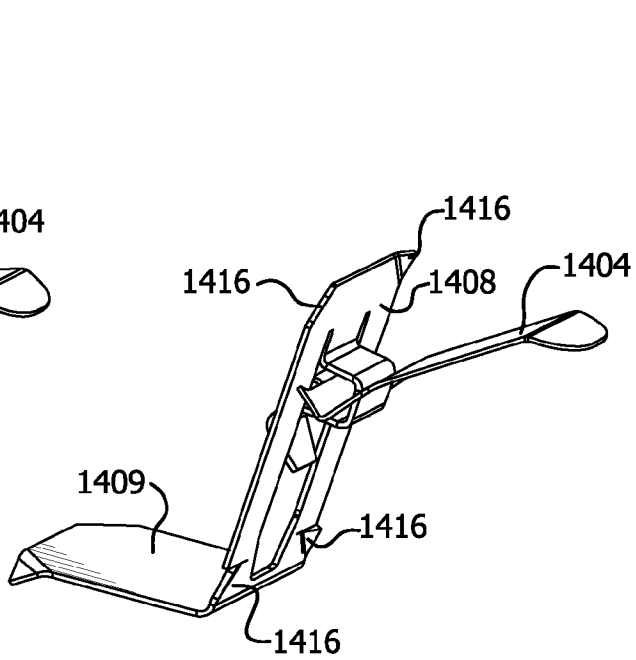
FIGS. 27*a*, 27*b*, and 27*c* show perspective views of the rear and left sides of the bracket assembly shown in FIGS. 24*a*, 24*b*, and 24*c*.
Figure 27B:
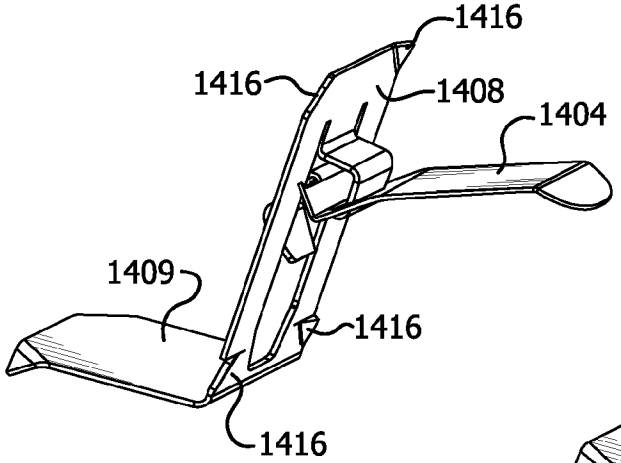
Figure 27A:
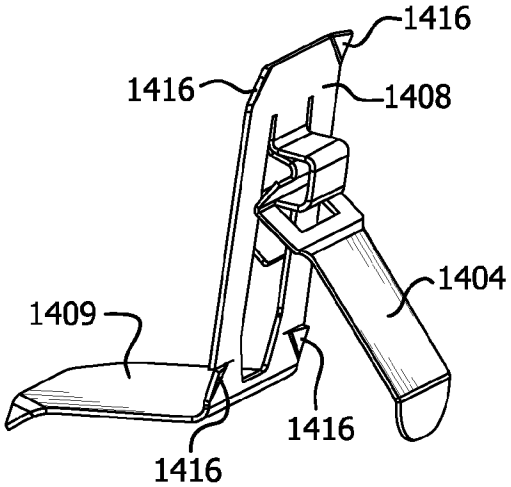

Referring to FIG. 23, wire form 1202 is provided to attach J-box 1100 to mounting brackets 1600 of housing 1012. Wire form 1202 comprises a u-shaped support 1204 with arms 1208 having ends 1206. J-box 1100 has cover 1102 that is secured without fasteners and without tools. Referring to FIGS. 5-8 and 14-17, ends 1206 of arms 1208 rotatably engage corresponding communications in mounting brackets 1600 that are attached along the top of top platform 1020 of housing 1012. Mounting brackets 1600 are provided in various embodiments including one embodiment that generally extends substantially along the length of top platform 1020 as shown in FIGS. 5-7 and 14-16 and another that is positioned adjacent light engine attached directly to top platform 1020. Wire form 1202 and mounting brackets 1600 can also be used with fixtures assembly 10.

Figure 6:
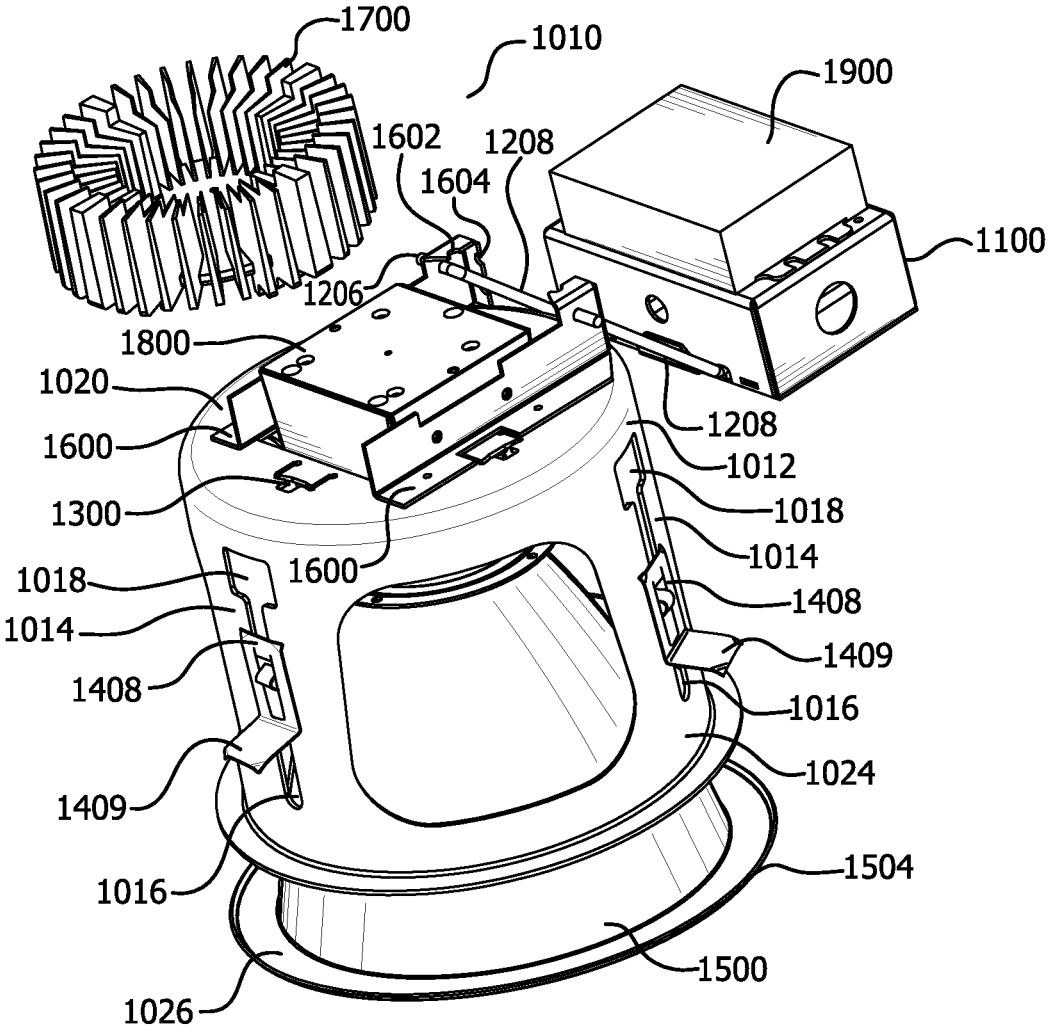
FIG. 6 shows a partially-exploded, perspective view of the top and left side of the fixture assembly shown in FIG. 5.
Figure 7:
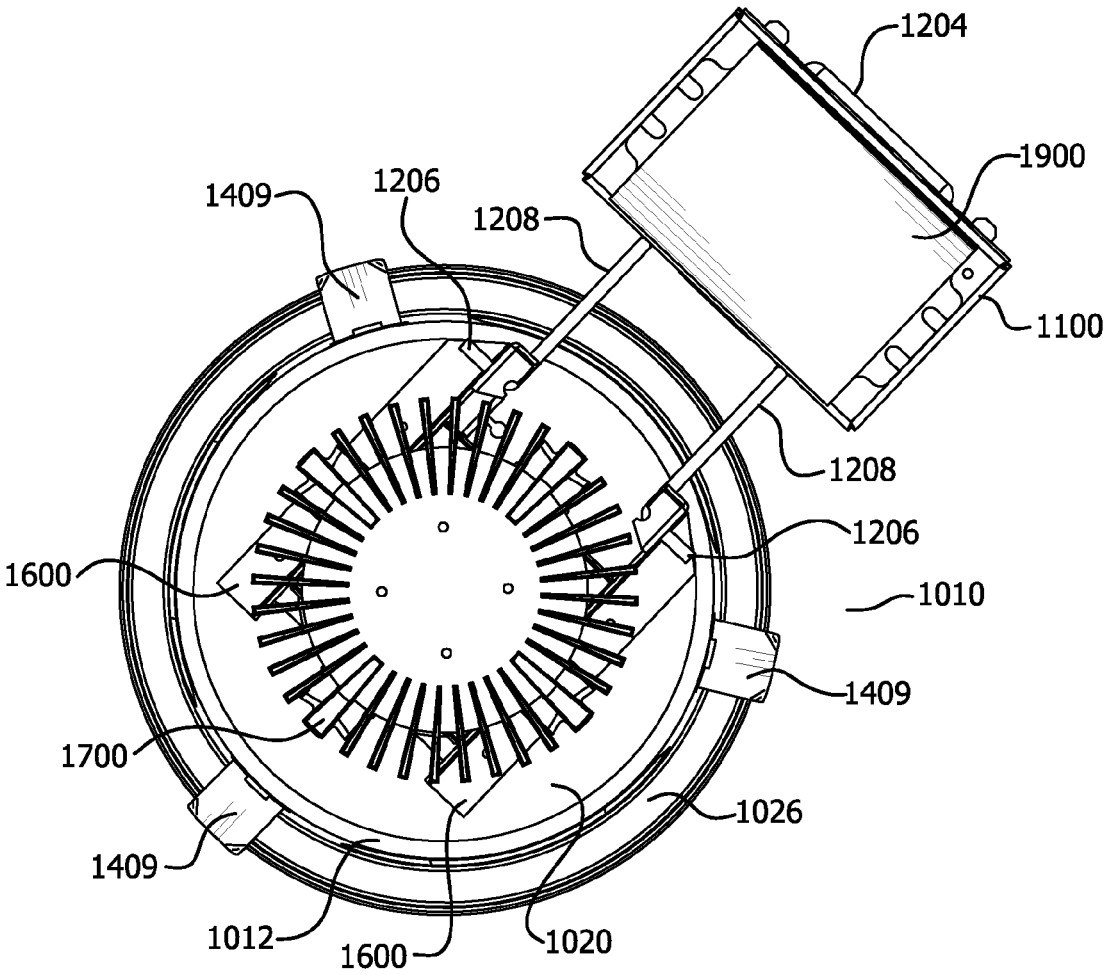
FIG. 7 shows a plan view of the top of the fixture assembly shown in FIG. 5.
Figure 8:
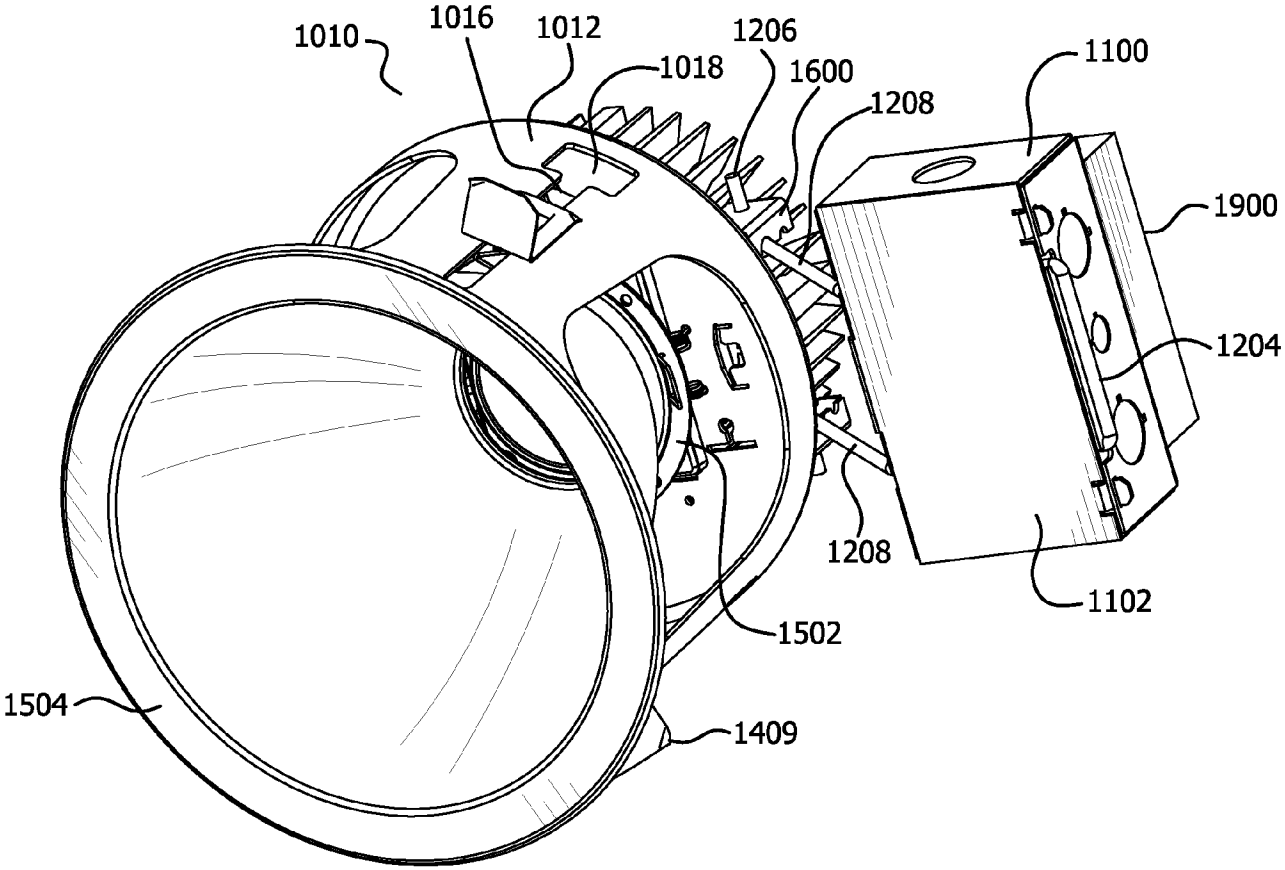
FIG. 8 shows a perspective view of the bottom and rear of the fixture assembly shown in FIG. 5.
Figure 16:
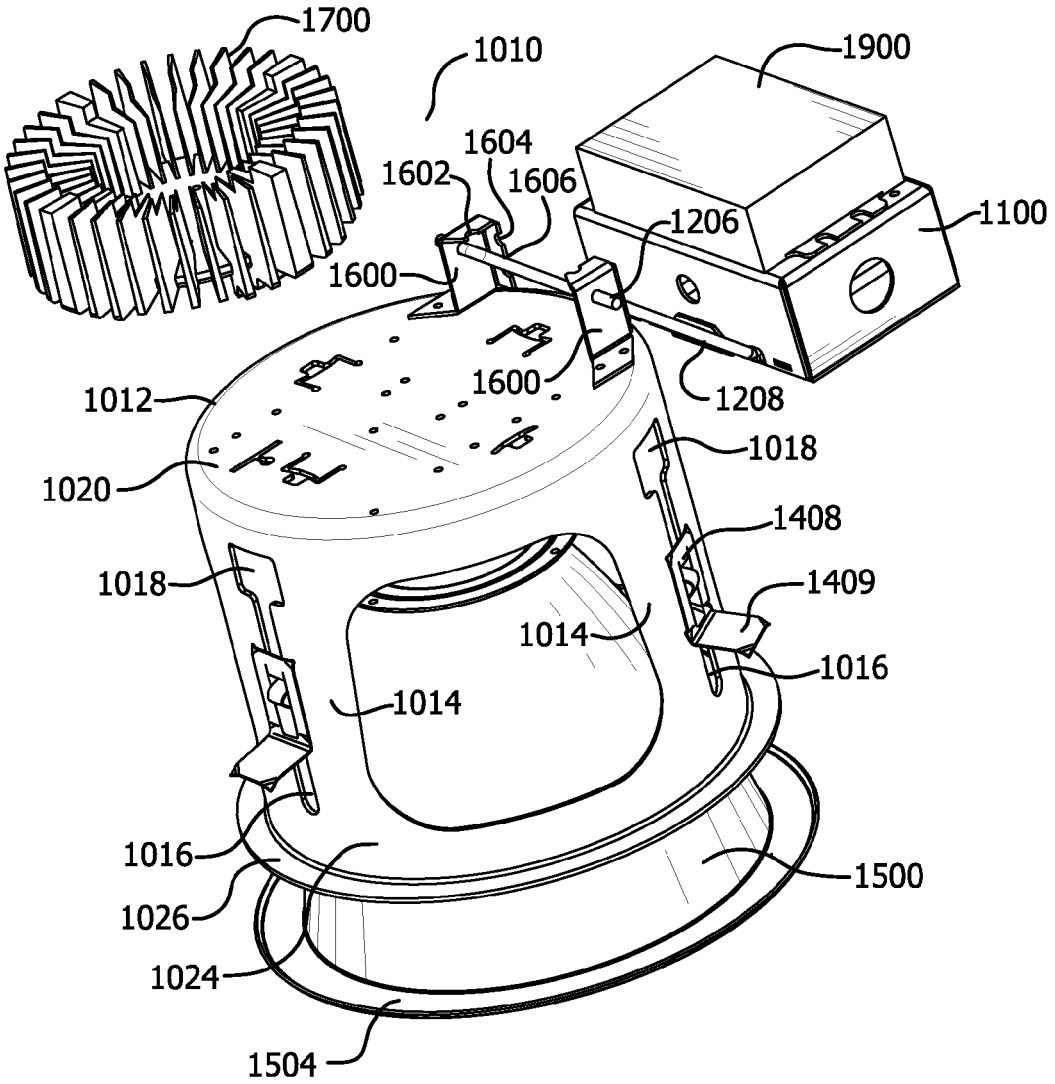
FIG. 16 shows a partially-exploded, perspective view of the top and left side of the fixture assembly shown in FIG. 14.
Figure 17:
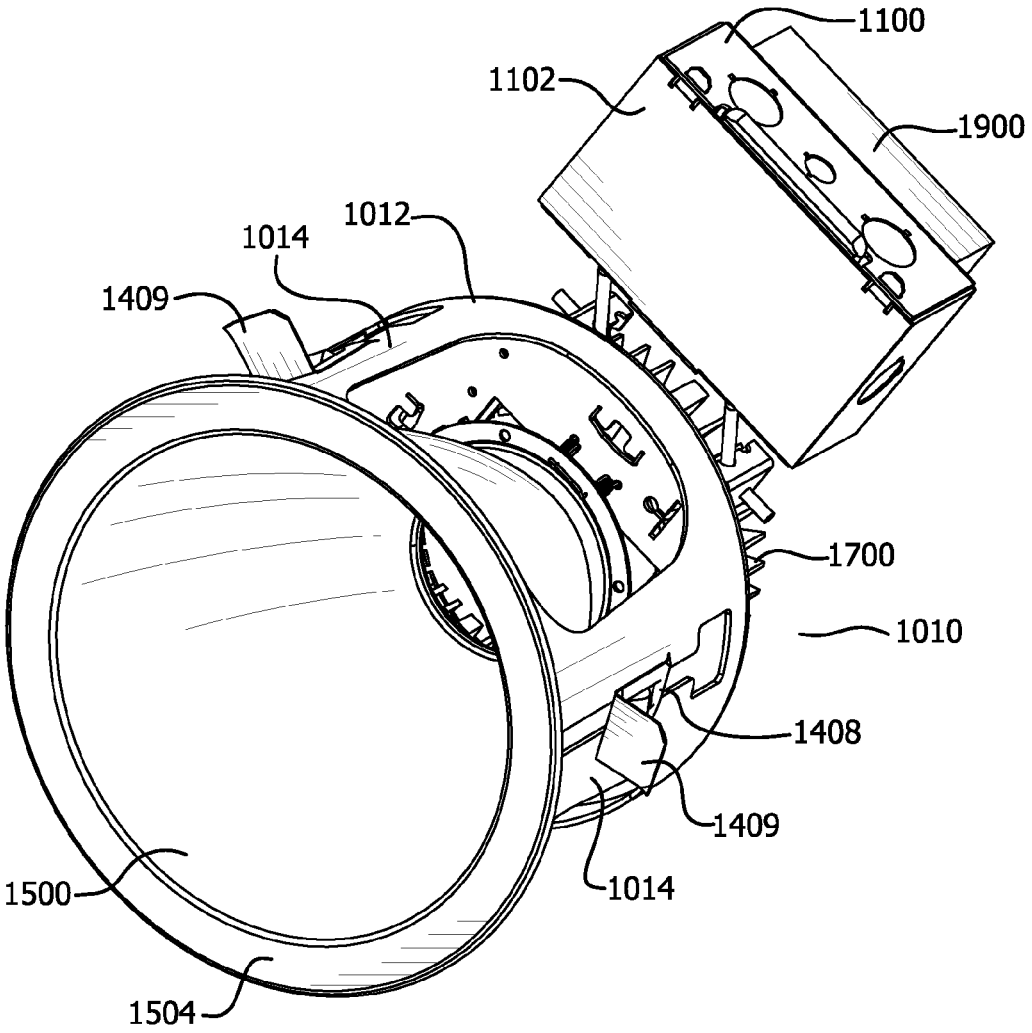
FIG. 17 shows a perspective view of the bottom and rear of the fixture assembly shown in FIG. 14.
Figure 22:
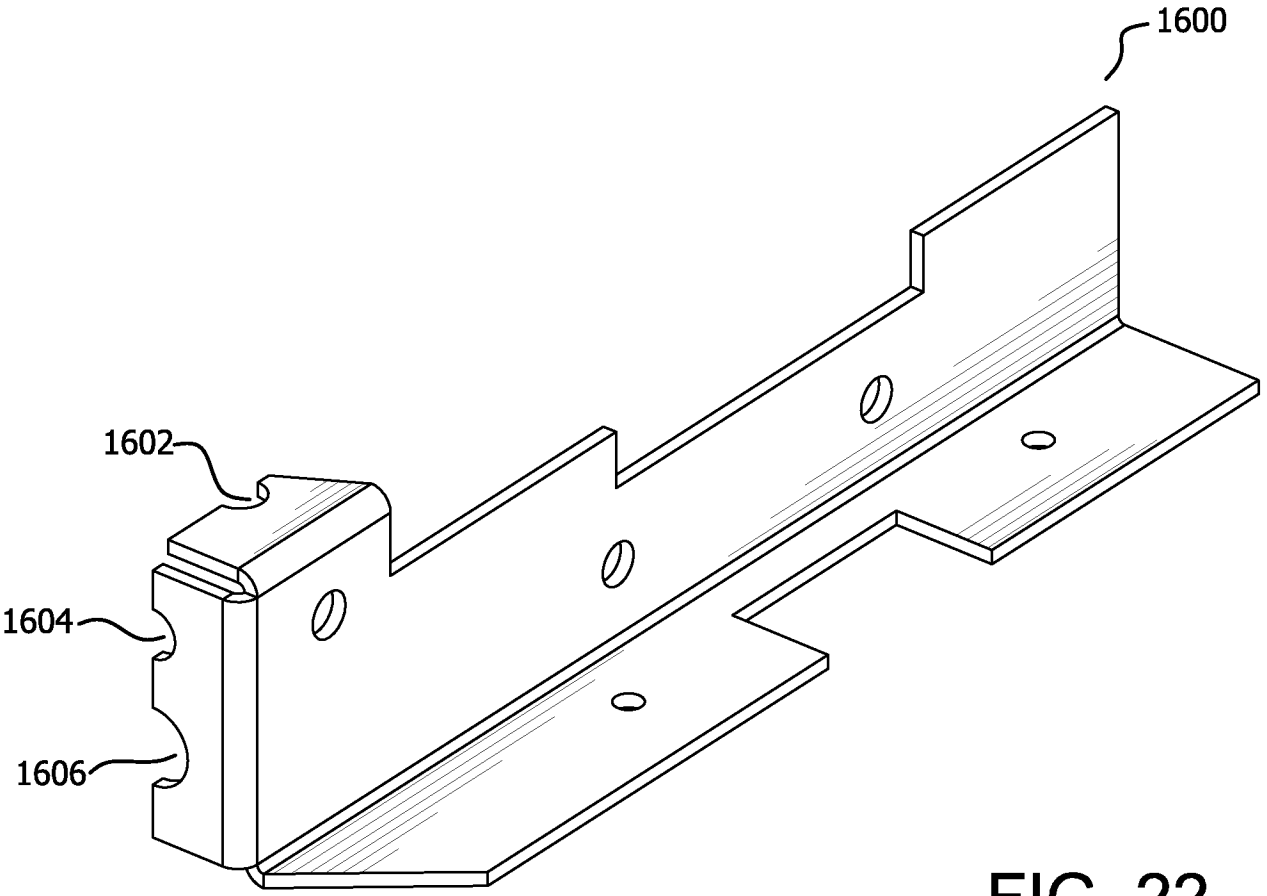
FIG. 22 shows a perspective view of a mounting bracket according to an embodiment of the invention.

Wire form 1202 is secured to and can be removed from mounting bracket 1600 without fasteners and without tools. A portion of arms 1208 adjacent ends 1206 removeably engage detents provided with mounting brackets 1600 as shown in FIGS. 5-6 and 14-15. The detents secure wire form 1202 and consequently J-box 1100 in several positions relative to housing 1012. For example, sets of corresponding detents are provided as upper detents 1602, middle detents 1604, and lower detents 1606 as shown in FIGS. 6, 16, and 22. Arms 1208 are substantially rigid to support J-box 1100 in a horizontal or non-vertical position in middle and lower detents 1604 and 1606. Arms 1208 can be moved from one set of detents to another by pushing the J-box 1100 up or down and allowing the arms 1208 to snap into place in a set of corresponding detents. Arms 1208 are deflectable if squeezed together by hand to release engagement of arms 1206 from detents and to rotate wire form 1202 and J-box 1100 into position in another set of detents or to remove wire form 1202 from mounting brackets 1600. The length of arms 1208 can vary to provide clearance for heat sinks when wire form 1202 is positioned in upper detents 1602.

Referring generally to FIGS. 6, 9, and 17-18, reflector 1500 comprises top flange 1502, body 1503, and bottom flange 1504. Top flange 1502 of reflector 1500 is configured to removeably engage torsion springs 1300 that secure reflector 1500 to top platform 1020. Torsion springs 1300 are attached by ends 1306 that engage communications provided through top platform 1020, as shown in FIGS. 5, 6, 9, 11, 18, and 20, without fasteners and without tools. Torsion spring 1300 includes coil 1302 that permits deflection of securement 1304 away from its bias toward the vertical axis of fixture assembly 1010 when torsion spring 1300 is installed with housing 1012. Alternatively, deflection clips 235 can also be used with housing 1012.

Referring generally to FIG. 6, light engine 1800 can be secured to mounting brackets 1600 or, alternatively, directly to top platform 1020 of housing 1012. Light engine 1800 is positioned relative to housing 1012 so that light can be emitted through communication 1022.

Fixture assemblies 10 and 1010 function as heat radiators and, in combination with heat sink 1700, assist in heat dissipation for the LED engine. For example, and in embodiments where mounting assembly 200 of fixture assembly 10 and housing 1012 of fixture assembly 1010 are manufactured from metal or metal alloy such as aluminum, assembly 200 and housing 1012 assist heat sink 1700 with heat management of the LED light or light engine 1800. Indeed, the heat generated by the LED light or light engine 1800 is conducted through the mounting brackets to the mounting assembly and housing. In an alternative embodiment with the LED light or light engine attached directly to top plate 205 or top platform 1020, heat can also be conducted to and dissipated by the mounting assembly and housing. The length of heat sinks 1700 can also be varied to optimize heat dissipation for various LED power packages. Heat management assists with optimizing the function and life of the LED light or light engine.

The installation methods for the second embodiment of fixture assembly 1010 can be performed without tools. Similar to fixture assembly 10, fixture assembly 1010 can be installed in new construction and also in retrofit installations. If installing in new construction, a rough-in kit or remodeling ring 4000 may be positioned above the ceiling and a hole must be cut into the ceiling that corresponds with a hole in the plate of a rough-in kit or remodeling ring 4000. For retrofits, the reflector of the installed fixture must be removed and the rough-in kit must remain in place above the ceiling or pushed to the side and a remodeling ring 400 may optionally be used rather than rough-in kit.

A tether can be used to assist in installation of assembly 1010 similar to installation of assembly 10.

Fixture assembly 1010 is prepared for installation. The first step of installing comprises attaching electric services to LED driver 1900 in J-box 1100 while fixture assembly 1010 is below the ceiling. Arms 1208 of wire form 1202 are placed in upper detents 1602 of mounting bracket 1600. Of course, this can occur before or after electric service is attached to LED driver 1900. If arms 1208 are not already engaged in upper detents 1602, arms 1208 can be squeezed together by hand to clear detents 1604 or 1606 but without removing ends 1206 from the communications of mounting bracket 1600. With arms 1208 clearing detents 1604 or 1606, wire form 1202 is rotated upwards and pressure released to allow arms 1208 to engage upper detents 1602. In this configuration, wire form 1202 and J-Box 1100 are generally positioned above housing 1012, light engine 1800, and heat sink 1700.

The next step of installation is to insert housing 1012 with wire form 1202 in upper detents 1602 through the hole cut in the ceiling. Alternatively, wire form 1202 may engage detents 1604 or 1606. Flange 1026 of housing ring 1024 may be placed flush with the bottom (exposed part) of the ceiling. In an alternative embodiment, flange 1026 may be placed within or even above the hole of the ceiling.

Retention clip 260 may be used with housing 1012 to install fixture assembly 1010 in a similar manner as fixture assembly 10.

Bracket assemblies 1400 may be preinstalled with housing 1012 and vertically adjusted so that legs 1409 of bracket 1408 contact either the rough-in plate, remodeling ring 4000, or the top surface of the ceiling. Prior to inserting fixture assembly 1010 through the hole in the ceiling, bracket assemblies 1400 are positioned in an upper position along slots 1016 of vertical supports 1014. In an alternative embodiment, and with bracket assemblies 1400 removed from housing 1012, fixture assembly 1010 is inserted through the hole in the ceiling. Then, bracket assemblies 1400 are installed by sliding brackets 1408 through openings 1018 from the inside of housing 1012. Lever arm 1404 should be in the released position or close to it. Each bracket assembly 1400 is then slid down along slots 1016 to rest on top surface of plate of rough-in kit, remodeling ring 400, or ceiling.

Each bracket assembly 1400 is then used to secure fixture assembly 1010 in place to a structure, such as, for example, the top of a ceiling or ceiling tile. Lever arm 1404 is pushed upward toward top platform 1020 to lock bracket assembly 1400 in position and to secure fixture assembly 1010 in place. As lever arm 1404 is pushed upward, teeth 1406 of lever arm 1404 embed in the inner surface of vertical support 1014. This pivotally secures lever arm 1404 to vertical support 1014 to assist in locking bracket assembly 1400. As lever arm 1404 continues to be pushed upward into the locked position, tongue 1405 of lever arm contacts support surface 1411 of bracket and pushes bracket 1408 in an opposite direction from the direction of movement of lever arm 1404. In other words, bracket 1408 is pushed down relative to vertical support 1014 while lever arm 1404 pivots upward into the locked position. Deflected prongs 1416 are provided with bracket 1408 to stabilize bracket 1408 against the semi-circular profile of vertical support 1014.

Support surface 1411 of bracket 1408 is spring-like and pushes against tongue 1405 of lever arm 1404 creating an even tension. As tongue 1405 of lever arm 1404 slides along support surface 1411, bracket 1408 continues to be pushed downward to tighten the housing against the ceiling (if the flange of the ring is not positioned within the hole in the ceiling). Once the lever's tongue 1405 moves past a geometric high point on support surface 1411, lever arm 1404 snaps into the locked position against vertical support 1014, creating a friction fit with vertical support 1014. Lever arm 1404 lays flat against inner surface of vertical support 1014 of housing 1012, allowing for installation of reflector 1500. This function is particularly beneficial when using wide-distribution reflectors that leave limited space between the reflector and the housing.

This step of locking bracket assembly 1400 is repeated for each bracket assembly 1400. The installation and locking of bracket assembly 1400 can be achieved by hand without the use of tools.

Lever arm 1404 can easily be moved from the secured position to the released position by moving lever arm 1404 away from top platform 1020 and toward ring 1024. As lever arm 1404 is moved, the friction fit is released, teeth 1406 disengage vertical support 1014, and tongue 1405 of lever arm 1404 is removed from contact with support surface 1411 of bracket 1408.

Wire form 1202 can be moved to middle or lower detents 1604 or 1606 at any time before installation of reflector 1500.

Reflector 1500 is then positioned substantially through the hole in the ceiling. With top flange 1502 of reflector 1500 in contact with deflection portions 1304 of torsion springs 1300, reflector 1500 is pushed toward top platform 1020 to offset deflection portion 1304 of torsion springs 1300 until deflection portion 1304 returns to its biased position to secure top flange 1502 of reflector 1500 in place adjacent top platform 1020 of housing 1012. Deflection clips 235 can also be used in place of torsion springs 1300.

Assemblies 10 and 1010 can be configured as, or to replace, any size fixture including, but not limited to, standard sizes for commercial and residential fixtures and custom sizes. For example, standard sizes include ring 215 or ring 1024 with 4-inch diameter, 6-inch diameter, 8-inch diameter, or any other standard size. Furthermore, the height of support arms 210 or vertical supports 1014 may also vary depending upon the diameter of ring 215 or ring 1024, geometric shape and/or size of the reflector, strength of illumination of LED light 400 or 1800, installation space above a ceiling or cabinet, or any other parameter that would affect the size of fixture assembly 10 or 1010. Fixture assembly 10 or 1010 can be customized to fit or retrofit any installation space.

Assemblies 10 and 1010 including all of their components can be fabricated with any one or combination of the following materials: metal or metal alloy, plastic, composite material, or the like.

Any make, model, size, and lumen LED light, LED engine, and LED driver, and heat sink, can be used with fixture assemblies 10 and 1010 and can be sourced from any manufacturer or vendor. By way of non-limiting example, the Philips Fortimo light engine, GE Infusion LED light engine, or the like can be used with the invention. Also, high lumen LED modules may also be used with the invention.

While the invention is described in conjunction with specific embodiments, it is evident that many alternatives, modifications, permutations, and variations will become apparent to those skilled in the art in light of the foregoing description. Accordingly, it is intended that the invention embraces all such alternatives, modifications, permutations, and variations as falling within the scope of the claims below.

What is claimed is:

1. A light fixture housing for an LED luminaire comprising:

a plate comprising a communication for light from the LED luminaire;

an annular base having a rim;

a plurality of supports extending from the plate to the annular base;

a slot aligned and positioned through each of the plurality of supports; and at least one mounting bracket that extends vertically from a top surface of the plate wherein the at least one mounting bracket comprises a communication that rotatably engages a deflectable arm attached to an electrical box and at least one locking detent that secures the deflectable arm in a position relative to the light fixture housing.

2. The light fixture housing of claim 1 wherein at least one mounting member for the LED luminaire is provided adjacent to the communication.

3. The light fixture housing of claim 2 wherein the at least one mounting member comprises a mounting surface positioned at about 90 degrees from a top surface of the plate.

4. The light fixture housing of claim 1 wherein the communication comprises any geometric shape.

5. The light fixture housing of claim 1 wherein a first end of the slot terminates adjacent to the annular base.

6. The light fixture housing of claim 5 wherein a second end of the slot extends partially into the plate.

7. The light fixture housing of claim 5 comprising an opening in communication with each slot wherein the opening is configured to receive a retention clip.

8. The mounting fixture housing of claim 1 comprising a retention clip, the retention clip comprising a bracket having an extended arm and a fastener.

9. The mounting fixture housing of claim 8 wherein each bracket is positioned along an outer surface of each support and wherein a portion of the fastener communicates from an inner surface of each support and through the slot.

10. The light fixture housing of claim 8 wherein the fastener is threaded and adjustable.

11. The light fixture housing of claim 10 wherein the fastener comprises a thumb screw, a wing nut, or bolt.

12. The light fixture housing of claim 8 wherein the fastener comprises a latch comprising a lever arm, a tongue, and teeth, and wherein the latch is in hinged communication with the bracket having a support surface.

13. The light fixture housing of claim 12 wherein the latch can be rotated relative to the bracket from an open position through intermediate positions to a lock position.

14. The light fixture housing of claim 13 wherein the tongue of the latch contacts the support surface the bracket when the latch is in any of the intermediate positions and the lock position.

15. The light fixture housing of claim 1 comprising a plurality of deflectable clips attached to a bottom surface of the plate.

16. The light fixture housing of claim 15 comprising a reflector having a flange, wherein the flange of the reflector is secured by the deflectable clips against the bottom surface of the plate.

17. The light fixture housing of claim 1 wherein the communications is configured to allow the deflectable arm to rotate on an axis that is parallel to a surface of the plate.

18. The light fixture of claim 1 wherein the locking detents comprise an upper set of detents and a lower set of detents.

19. A light fixture assembly comprising:

a plate comprising a communication for light from a LED luminaire that is attached to an upper surface of the plate;

an annular base having a rim;

a plurality of supports extending from the plate to the annular base;

a slot aligned and positioned through each of the plurality of supports wherein a first end of the slot extends partially into the plate; and a retention clip engaged within each slot.

20. The light fixture housing of claim 19 wherein a second end of each slot terminates adjacent to the annular base.

21. The light fixture housing of claim 20 comprising an opening in communication with each slot wherein the opening is configured to receive a retention clip.

22. The mounting assembly of claim 19 wherein each retention clip comprises a bracket having an extended arm and a fastener.

23. The light fixture housing of claim 22 wherein the fastener comprises a threaded and adjustable fastener and an extended arm.

24. The light fixture housing of claim 22 wherein the fastener comprises a latch comprising a lever arm, a tongue, and teeth, and wherein the latch is in hinged communication with the bracket having a support surface.

25. The light fixture housing of claim 24 wherein the tongue of the latch contacts the support surface the bracket when the latch is in the intermediate positions and the lock position.

26. The light fixture housing of claim 19 comprising a plurality of deflectable clips attached to a bottom surface of the plate.

27. The light fixture housing of claim 26 comprising a reflector having a flange, wherein the flange of the reflector is secured by the deflectable clips against the bottom surface of the plate.

28. The light fixture housing of claim 19 comprising mounting brackets attached to a top surface of the plate wherein the mounting brackets comprise support communications configured to rotatably engage a support for an electrical box and locking detents for the support.

29. The light fixture housing of claim 28 wherein the support communications are configured to allow the support to rotate on an axis that is parallel to a surface of the plate.

30. A method for installing a light fixture assembly comprising:

positioning the light fixture assembly through a hole in a ceiling substantially within an above-ceiling space, wherein an annular base of the light fixture assembly is level with or slightly above a lower surface of the ceiling;

positioning retention clips along and partially within slots provided through a plurality of supports of the light fixture assembly wherein extended arms of a bracket of the retention clips contact an upper ceiling surface, locking the retention clips in place against the plurality of supports to maintain the position of the light fixture assembly relative to the ceiling; and engaging an upper rim of a reflector with deflection clips attached to a bottom surface of the plate of the light fixture assembly.

31. The method of claim 30 wherein before positioning the light fixture assembly through the hole in the ceiling, retention clips are slid along the slots to an upper position adjacent the plate.

32. The method of claim 30 wherein the step of positioning the retention clips along slots comprises inserting a latch or the bracket of the retention clip through an opening in communication with each slot.

33. The method of claim 30 wherein the step of locking the retention clip in place comprises tightening a threaded device to secure the brackets of the retention clips against an outer surface of each of support.

34. The method of claim 30 wherein the step of locking the retention clip in place comprises rotating a lever arm of a latch of the retention clip from an open position to a lock position.

35. The method of claim 34 wherein teeth of the lever arm engage an inner surface of the support and a tongue of the latch places downward force on a support surface of the bracket of the retention clip while rotating the lever arm from the open position to the lock position.

36. The method of claim 30 comprising before positioning the light fixture assembly through a hole in a ceiling, rotating an electrical box assembly into and secured in an upright position relative to the light fixture assembly, wherein the electrical box assembly comprises a support that rotatably engages communications in mounts attached to a top surface of the plate of the light fixture assembly.

37. The method of claim 30 wherein the electrical box assembly is rotated to and secured in a lower position relative to the light fixture assembly after the light fixture assembly is positioned through the hole in the ceiling.

38. The method of claim 30 comprising connecting electrical service to the light fixture assembly.

* * * * *